US011008688B2

(12) United States Patent
Luaces

(10) Patent No.: US 11,008,688 B2
(45) Date of Patent: May 18, 2021

(54) PORTABLE APPARATUS AND METHOD FOR MOUNTING EMBROIDERY HOOPS

(71) Applicant: Pablo Luaces, Coral Springs, FL (US)

(72) Inventor: Pablo Luaces, Coral Springs, FL (US)

( * ) Notice: Subject to any disclaimer, the term of this patent is extended or adjusted under 35 U.S.C. 154(b) by 140 days.

(21) Appl. No.: 16/504,301

(22) Filed: Jul. 7, 2019

(65) Prior Publication Data

US 2021/0002803 A1 Jan. 7, 2021

(51) Int. Cl.
*D05B 91/10* (2006.01)
*D05C 1/02* (2006.01)

(52) U.S. Cl.
CPC ..... *D05B 91/10* (2013.01); *D05C 1/02* (2013.01)

(58) Field of Classification Search
CPC ..... D05B 91/00; D05B 91/10; D05B 79/00; D05C 1/00; D05C 1/02; D05C 1/04; D05C 9/04; D05C 9/22; D05C 13/00; D06C 3/08
See application file for complete search history.

(56) References Cited

U.S. PATENT DOCUMENTS 4,545,127 A * 10/1985 Barry ..... G01B 5/00 33/613
4,553,728 A * 11/1985 Corsello ..... A47B 23/007 248/444.1

(Continued)

*Primary Examiner* — Ismael Izaguirre
(74) *Attorney, Agent, or Firm* — Hector M. Reyes Rivera

(57) ABSTRACT

An apparatus for mounting dual hoop assemble in a predetermined and selected area of an item that includes a base and a mounting section including panels that is connected to the base via a connecting system that allows the mounting area to move outwardly and inwardly in relation to the base and left to right and vice versa in regards to the proximal end of the base. The apparatus includes two inner hoop support sections that are able to tightly hold and support the inner section of a dual hoop assemble of any size and shape, each one of said inner hoop support section having one elongated plates with a central groove; knurled screws inserted in a groove, holding brackets inserted in aid knurled screws and knurled screw handle knobs to secure each one of the holding brackets. Loosening or tightening said handle knobs facilitates the selection of a predetermined horizontal position of the inner hoop holding brackets in the mounting section. The inner hoop holding sections are connected to sliding units of lateral supports via knurled screws. Loosening said knurled screws allows the movement of the inner hoop holding section vertically along the mounting section, while tightening said knurled screws, allows the inner holding section to be confined in a predetermined and selected position. The holding brackets included in the apparatus are able to hold the inner hoop section of a dual hoop assembles of different sizes and shapes. In some embodiments of the invention, a central panel comprises a second mounting area convenient for mounting dual embroidery assembles onto small items, once the central panel is repositioned along the base, thus providing an apparatus with a dual mounting area for items of different sizes. In other embodiments, the central panel may be withdraw from the mounting section, generating a mounting section ideal for embroidering medium size items.

8 Claims, 18 Drawing Sheets

(56) References Cited

U.S. PATENT DOCUMENTS

| | | | | | |
|---|---|---|---|---|---|
| 4,957,261 | A | * | 9/1990 | Cirami | A47B 19/10 248/451 |
| 5,433,158 | A | * | 7/1995 | Moore, III | D05C 9/04 112/103 |
| 5,590,613 | A | * | 1/1997 | Head | D05C 9/04 112/103 |
| 5,624,096 | A | * | 4/1997 | Haynes | A47B 23/042 248/451 |
| 5,934,210 | A | | 8/1999 | Lucchese | |
| 6,067,737 | A | * | 5/2000 | Guenther | D05C 9/04 112/103 |
| 6,116,174 | A | * | 9/2000 | Melton | D05C 13/00 112/103 |
| 6,216,617 | B1 | | 4/2001 | Burt, Jr. | |
| 7,350,678 | B1 | | 4/2008 | Austin | |
| 7,610,868 | B2 | | 11/2009 | Gardner | |
| 8,584,606 | B2 | | 11/2013 | Mack et al. | |
| 9,745,681 | B2 | | 8/2017 | Warwick | |
| 2016/0340817 | A1 | | 11/2016 | Taylor et al. | |

* cited by examiner

PORTABLE APPARATUS AND METHOD FOR MOUNTING EMBROIDERY HOOPS

TECHNICAL FIELD

The invention relates to the process of preparing a given article for embroidery or similar process. More particularly, the instant invention relates to a portable and versatile apparatus and method for accurately positioning a dual embroidery hoop assemble in a section of an article to be embroidered or subjected to a similar process.

BACKGROUND

Embroidery of garments and other items is a very well known process, which is directed to decorate fabrics and other items. The section of the material to be embroidered requires to be stretched or tensed previous to be embroidered. A convenient manner to obtain a taut fabric section is to positioning said fabric section in between a dual hoop assemble, which consists of two different sections: an inner section that receives the fabric in the first place, and an outer section that, once is snap into the inner section, capture or enclosed the section of the fabric to be embroidered. The prior art discloses different devises useful in the positioning of dual hoop assemble in a fabric. However, in some instances, such devices must be connected to frames and usually are permanently installed in heavy benches and they are difficult to move from one place to another and are intended to be used in a particular working area. Furthermore, most of the known embroidery devices are designed to be used only with a dual hoop assemble of a particular shape or geometry and of a particular size, thus such devices are of limited or restricted used. Another limitation of known embroidery devices is that they are used in embroidering single size items only, which also limits the use of such devices in embroidering items of different sizes. Another difficulty of the process of mounting a dual hoop assemble in a fabric is the lack of reproducibility or accuracy in positioning the embroidering in a particular position of a given multiple number of the same items to be embroidered, such as the uniforms of social, sports and other groups. Therefore, there is a need of a portable, collapsible, light weight apparatus for mounting or positioning fabrics in a dual hoop assemble that may be used with dual hoop assemble of any shape and sizes and that provides the versatility in mounting sections for items of different sizes and that facilitates the mounting or positioning of the dual hoop assemble in the same position of items of the same type, thus providing a high degree of accuracy and reproducibility in the process of positioning an embroidering in the same position of multiple items of the same type.

SUMMARY OF THE INVENTION

The herein invention provides an apparatus for positioning a dual hoop assemble into fabrics to be subjected to embroidering or similar process. The herein disclosed apparatus is portable and light weight, thus it is easy to be carried to different places. The apparatus is collapsible, thus it is easy to store and furthermore, it is highly versatile since it may be used in large, medium and small items to be embroidered or subjected to similar processes. The apparatus provides a mounting area of at least three independent panels that are joined but not physically interconnected. Such mounting area has a front flat area configured to firmly hold the inner part of a dual hoop assemble of any shape or geometry in any predetermined position of the mounting area and to receive the fabric to be embroidered or subjected to similar processes and to further snapping the outer part dual hoop assemble in a predetermined area of the item already over the inner part of the dual hoop assemble. The mounting area also comprises a coordinate system in order to positioning the hoop assembly in the same position on a set of items of the same size and shapes with excellent accuracy. Said mounting area may be easily reduced in order to receive medium size items wanted to be embroidered but retaining the ability to firmly hold the inner part of dual hoop assemble of any shape. It also provides a suitable alternative mounting section for holding an inner part of a dual hoop assemble wherein even smaller items such as socks, caps, sleeves, baby clothes and the like are conveniently pinched in between the inner and outer parts of a dual hoop assemble of any shape.

BRIEF DESCRIPTION OF THE DRAWINGS

The foregoing and additional features and characteristics of the embodiments of the present invention will become more apparent from the following detailed description considered with reference to the accompanying drawings, which are used herein in a manner of example only, and wherein.

DETAILED DESCRIPTION OF THE INVENTION

The present invention and its detailed embodiments are disclosed herein; however, it is to be understood that the disclosed embodiments are merely exemplary of the invention that may be embodied in various and alternative forms within the scope of the invention. It is thus to be understood that, this invention is not limited to particularly exemplified structures, components, methods or uses, as such may, of course, vary. The drawings are not necessarily to scale; some features may be exaggerated or minimized to show details of particular components. It is also to be understood that the terminology used herein is for the purpose of describing particular embodiments of the invention only, and is not intended to limit the scope of the invention in any manner. It must be noted that, as used in this specification and the appended claims, the singular forms "a", "an" and "the" include plural referents unless the content clearly dictates otherwise.

Therefore, specific structural and functional details disclosed herein are not to be interpreted as limiting, but merely as a representative basis for the claims and/or as a representative basis for teaching one skilled in the art how to make and to use the present invention.

In general terms, the instant invention comprises an apparatus for mounting a dual hoop assembly onto a section of an article to be embroidered or to be subjected to any other similar process. The herein described apparatus is lightweight and collapsible and thus may be compacted and easy to carry or transport form one place to another according to the User's needs. It is also highly versatile since it may be used to positioning dual embroidering hoops having different sizes, shapes or geometries on items that may also have different sizes. Furthermore, the apparatus is highly convenient in positioning a given embroidery in the same place in a given sets of identical garments with high accuracy. Different embodiments of said apparatus are herein also disclosed.

Figure 1:
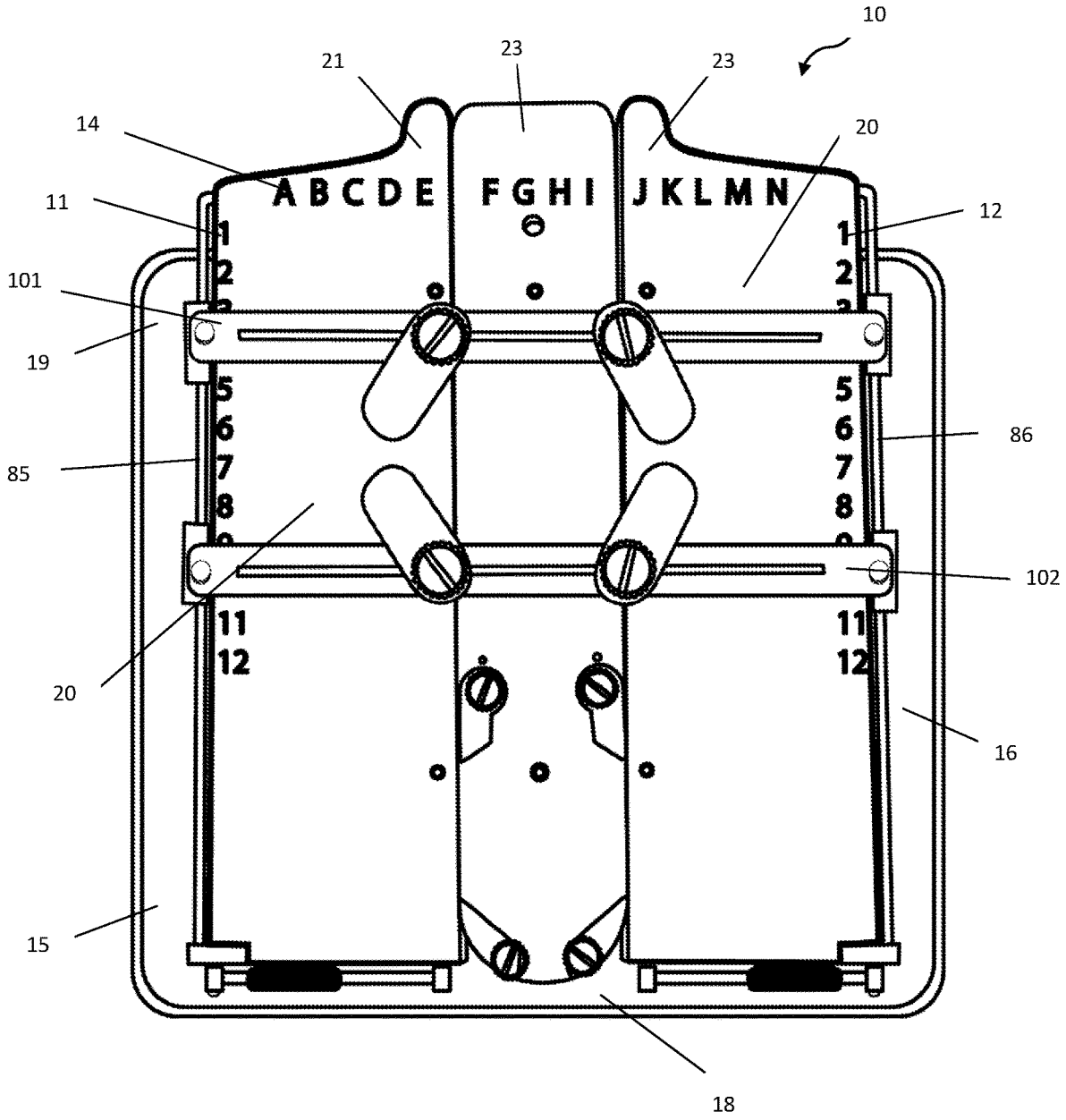
FIG. 1 shows a top view of an embodiment of the invention in a collapsible or folded configuration.
Figure 2:
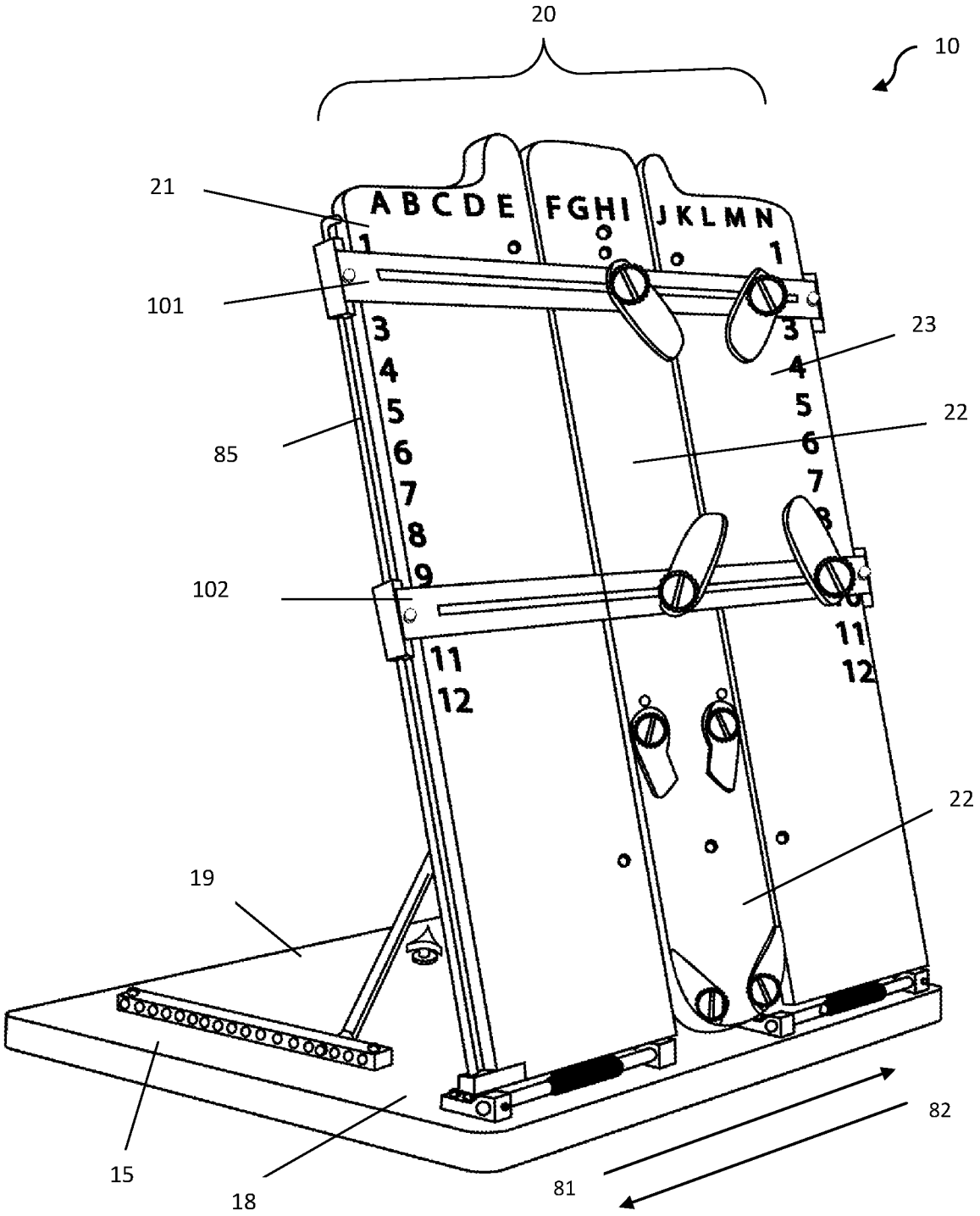
FIG. 2 illustrates a perspective front view of the embodiment of the invention illustrated in FIG. 1 in an open configuration.
Figure 3:
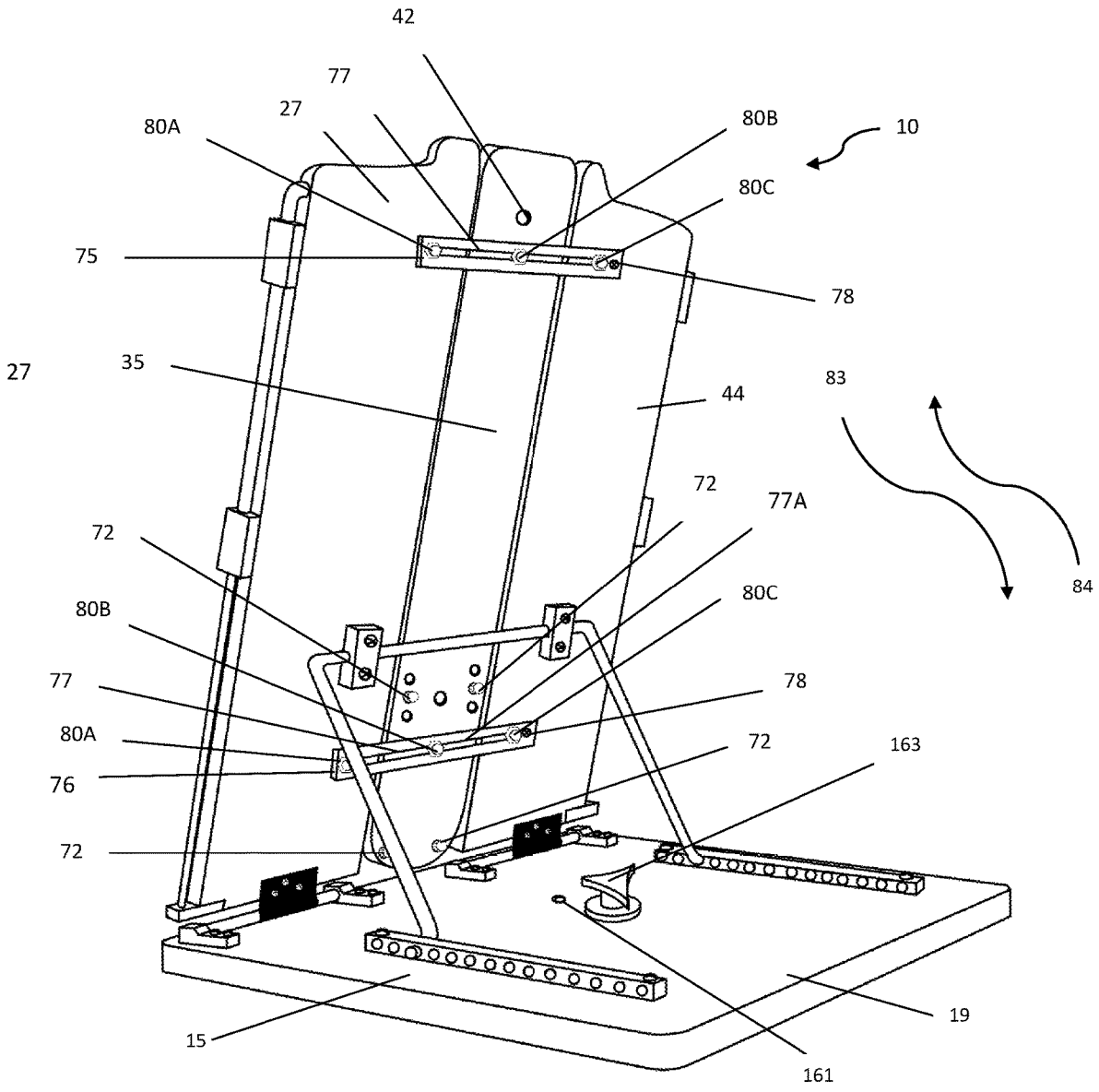
FIG. 3 shows a perspective back view of the embodiment of the invention illustrated in FIG. 2.

FIG. 1 illustrates embodiment 10, according to the invention, showing the embodiment in a compacted or closed configuration. On the other hand, FIGS. 2 and 3, illustrate a front perspective view and a rear perspective view, respectively, of embodiment 10 in an open, non compacted configuration. By convention, the front section of the embodiment 10 is designated as the one illustrated in FIGS. 1 and 2, showing a first column of numbers 11, located on its left side, a second column of numbers 12, positioned on its right side and a row of letters 14 on its upper section. As shown in FIGS. 1-3, embodiment 10 comprises a base section 15, wherein other sections of the embodiment 10 are supported. Said base 15 comprises flat top surface 16, a flat bottom surface 17, a proximal end 18 and a distal end 19. Embodiment 10 also comprises mounting section 20, suitable to receive the item or fabric to be embroidered and to further mounting said fabric on the embroidery dual loop assemble required in the embroidering or other similar process, as explained below.

Figure 5:
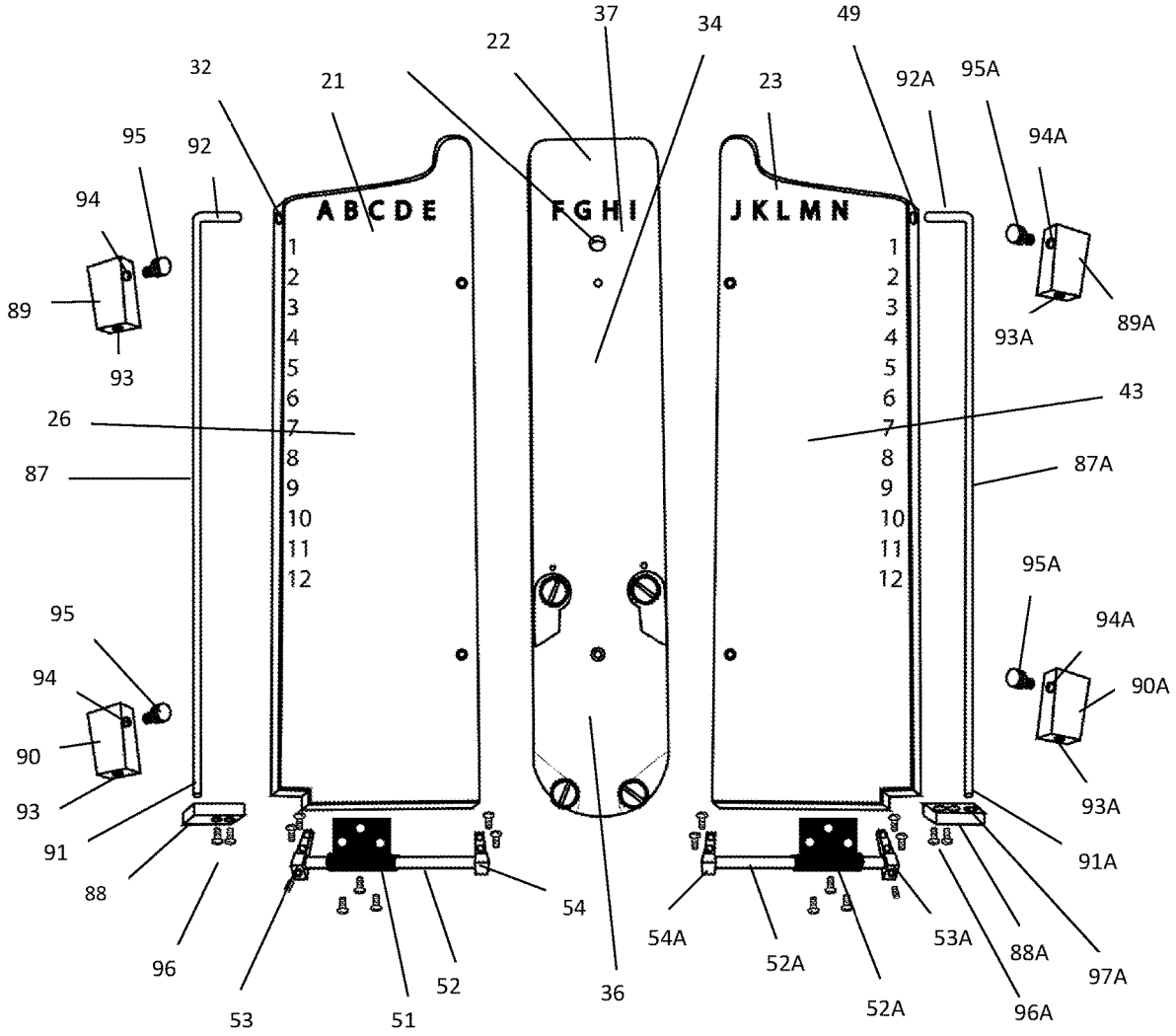
FIG. 5 illustrates front views of different components of embodiments according to the invention, wherein the base and the section for holding the inner hoop of a dual embroidery assembly have been omitted for clarity.

As illustrated in FIGS. 2, 3 and 5, said mounting section 20 comprising first panel 21 on the left, second panel 22, on the right, and a third panel 23, located on the center; all of said panels are not physically connected and are placed in an aligned position relative to one another; thus providing mounting section 20, which comprises flat front surface 24 and flat rear surface 25.

Base 15 and first, second and third panels 21-23 may be made of any suitable hard, solid material such as laminated melamine, wood, plastic, hardwood plywood, fiberboard, apple plywood, particle board, polyvinylchloride (PVC) and the like.

Figure 6:
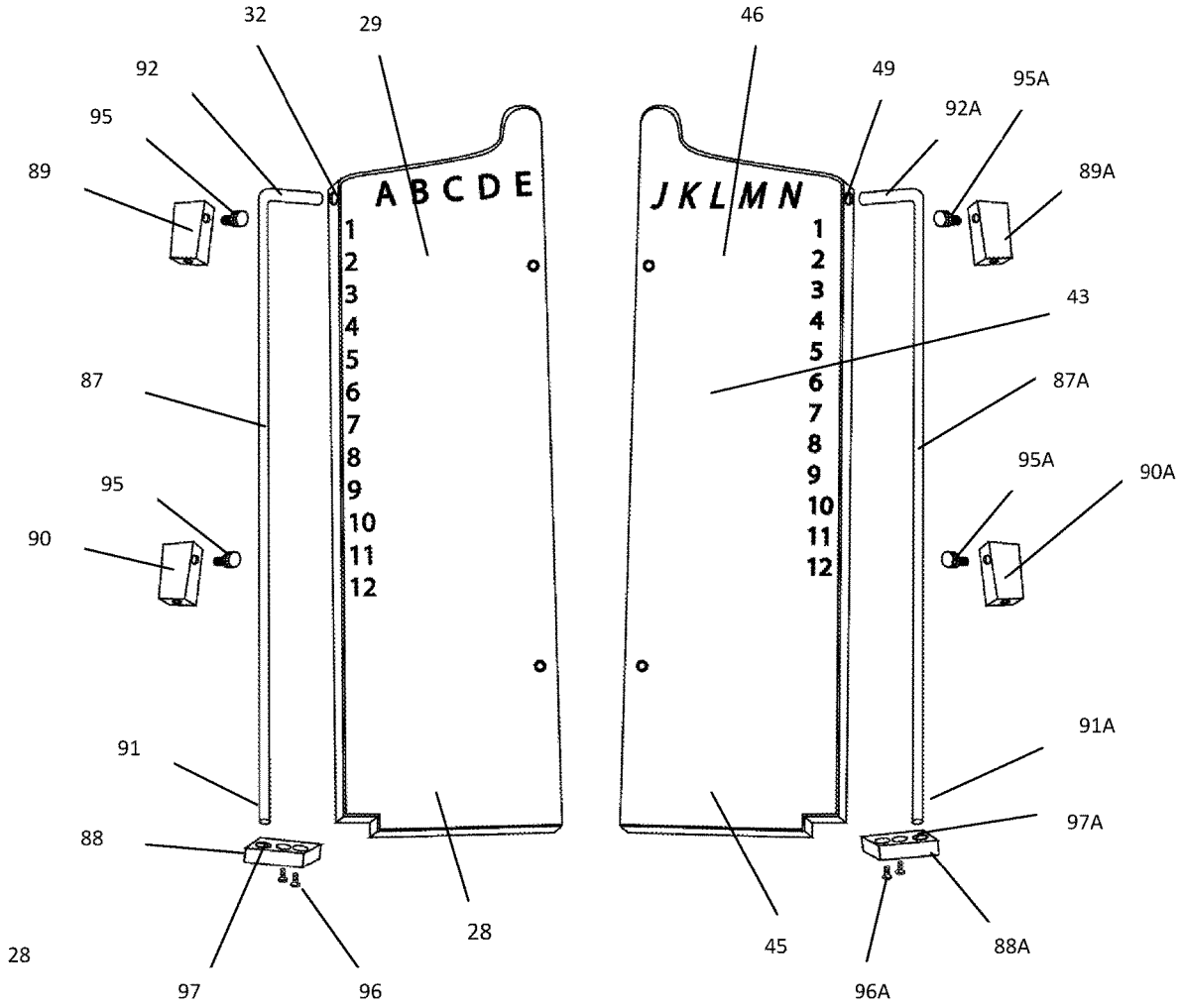
FIG. 6 illustrates views of different parts and details of the lateral supports used in embodiments according to the invention.

As illustrated in at least FIGS. 5 and 6, first panel 21 comprises flat front surface 26, a flat back surface 27, proximal end 28, distal end 29, left side 30, and a right side 31. It also comprises opening or hole 32 on its left side 30; column of numerals 11 on the left side 29 and a section of the row of letter 14 on its distal end 29.

As shown, for instance in FIGS. 1, 2, 5 and 6, second panel 22 is aligned next to first panel 21 and it comprises flat front surface 34, flat back surface 35, proximal end 36, distal end 37, left side 38, and right side 40. It also comprises a section of the row of letters 14 on or near its distal end 37 and aperture or hole 42. Similarly, third panel 23 is aligned in a parallel position with respect to first panel 21 and second panel 22 and it comprises flat front surface 43, flat back surface 44, proximal end 45, distal end 46, left side 47, a right side 48 and opening 49, located at its lateral right side 48. It also comprises column of numerals 12 at its right side 48 and a section of the raw of letters 14 on near its distal end 46. As shown in at least FIGS. 1 and 2, identical numbers in number columns 11 and 12 are aligned to each other.

Figure 4:
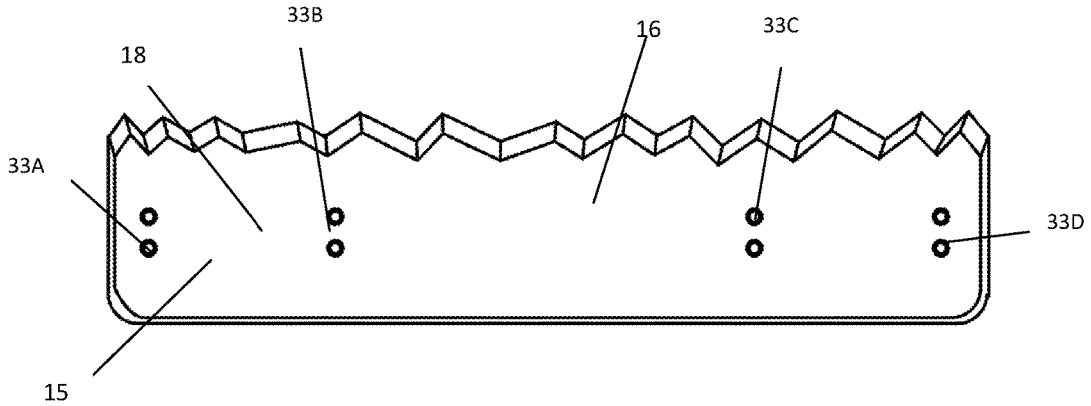
FIG. 4 Illustrates different components of the connecting system used in embodiments according to the invention in order to connect the mounting section to the base.
Figure 4:
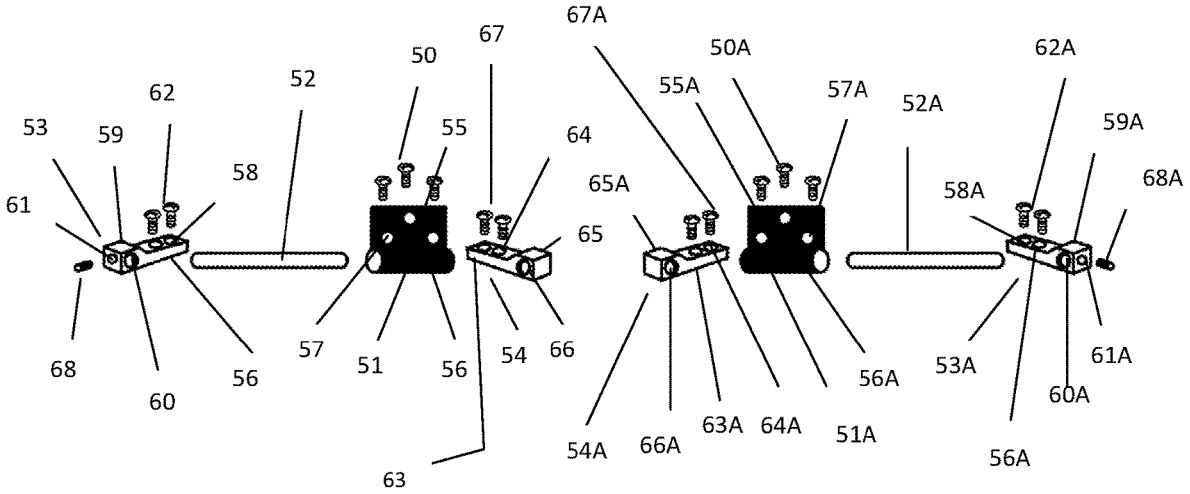

As illustrated, for instance in FIGS. 1, 2 and 3, mounting section 20 is connected to base 15 by a connecting system, wherein first and third panels 21 and 23 are connected to base 15. Different components of said connecting systems are illustrated in detail on FIGS. 4, 5 and 6. More particularly, and regarding first panel 21, proximal end 28 of first panel 21 is connected to the left side of the proximal end 18 of base 15. FIG. 4 illustrates different components of the said connection comprises hinge 51, elongated cylindrical pin 52, a first base connecting unit 53 and second base connecting unit 54. Hinge 51 comprises a flat section 55 and a hollow cylindrical section 56. Said flat section 55 comprises openings 57 that are used in fastening and securing hinge 51 to the lower part of the back section 27 of first panel 21 via screws 50.

Regarding first base connecting unit 53, it comprises a main body having a lower rectangular section 56 having openings 58 and a semi-square section 59, which comprises aperture 60 which passes through said semi-square section 59 and threaded aperture 61, which is perpendicular to and in direct communication with aperture 60. As illustrated in FIG. 4, first base connecting unit 53 is connected to base 15 by fastening screws 62 through openings 58 and openings 33A on base 15.

Similarly, second base connecting unit 54 comprises a main body having a lower rectangular section 63 having openings 64 and a semi-square section 65, which comprises aperture 66, that passes through said semi-square section 65. Second base connecting unit 54 is then connected to base 15 by fastening screws 67 though openings 64 and 33B on base 15. The connection of first panel 21 to the base 15 is then completed by inserting the elongated cylindrical pin 52 through the hollow cylindrical section 56 of hinge 51; followed by inserting first and second end of the elongated cylindrical body of pin 52 into apertures or openings 60 and 66 on the semi square sections 59 and 65, respectively, and further fastening screw 68 —preferably an Allen headless screw-through threaded opening 61 on first connecting unit 53 until it locks or confines pin 52 in between first connecting unit 53 and second connecting unit 54.

In this manner, hinge 51 and thus, first panel 21 are allowed to move or to slide from left to right of base 15 and vice versa, along said elongated pin 52, as well as it is also allow to freely rotating inwardly and outwardly in relation to base 15. Said connection of first panel 21 is connected to base 15 is illustrated, for instance in FIGS. 2 and 3, wherein is shown the proximal end 28 of first panel 21 connected to the left side of the proximal end 18 of base 15.

As shown in FIGS. 2, 3, 4 and 5 third panel 23 is also connected to base 15 using the same or identical parts: hinge 51A, elongated cylindrical pin 52A, a first base connecting unit 53A and second base connecting unit 54A. The interconnections of such parts in the process of connecting panel 23 to base 15 proceeds as already explained above in the connection of the first panel 21 to base 15: like hinge 51, hinge 51A, comprises a flat section 55A and a hollow cylindrical section 56A. Said flat section 55A comprises openings 57A that are used in fastening and securing hinge 51A to the lower part of the back surface 44 of first panel 23 via screws 50A.

Similarly, first base connecting unit 53A, comprises a main body having a rectangular section 56A having openings 58A and a semi-square section 59A. Said semi-square section 59A comprises aperture 60A passing through said semi-square section 59A and threaded aperture 61A, which is perpendicular to and in direct communication with aperture 60A. First base connecting unit 53A is fastened to base 15 by inserting or fastening screws 50A through openings 58A and 33D on base 15.

In a similar manner, second base connecting unit 54A, comprising a main body having a rectangular section 63A having openings 64A and a semi-square section 65A, which comprises aperture 66A passing through said semi-square section 65A. Second base connecting unit 54 is then connected to base 15 by fastening screws 67A through openings 64A on upper surface 16 and openings 33C on base 15. The connection of third panel 23 to the base 15 is then completed by inserting elongated cylindrical pin 52A through the hollow cylindrical section 56A of hinge 51A; followed by inserting first and second end of the elongated cylindrical body of pin 52A into apertures or openings 60A and 66A on the semi square sections 59A and 66A, respectively, and further fastening screw 68A; —preferably an Allen headless screw-through threaded opening 61A on first connecting unit 53A until it locks or confines pin 52A in between first connecting unit 53A and second connecting unit 54A.

In this manner, proximal end 45 of third panel 23 is connected to the right side of the proximal end 18 of base 15. Thus, as panel 21, by the action of the sliding of hinge 51, panel 23 is also allowed to move or to slide from left to right of base 15 and vice versa along said elongated pin 52A, as well as to freely rotate inwardly and outwardly in relation to base 15. Connecting units 53, 53A, 54 and 54A and pins 52 and 52A are made preferably of aluminum or any other suitable material such as stainless steel, steel, brass, plastic and the like.

Regarding the second panel 22, it is not connected to the base 15 at all, even though it is firmly aligned and inserted in between the first and third panels 21 and 23. As illustrated, in at least in FIG. 3, second panel 22 is joined and aligned to first and third panels 21 and 23 by means of at least a first joining plate 75 and a second joining plate 76. As illustrated in FIG. 3, elongated joining plate 75 comprises a flat rectangular body, having a centered elongated groove 77 and opening 78. Plate 75 is fastened to the upper section of the back surface of the embodiment 10 by inserting and fastening screw 79 through aperture 78. Similarly, panels 21, 22 and 23 are placed in an align position to one another by inserting flat head screws 80A, 80B and 80C from the front surfaces to the back surfaces of said panels, wherein they are inserted through the centered elongated groove 77 and are properly secured with washers and nuts, as illustrated in FIG. 3.

Similarly, second joining plate 76, identical to first joining plate 75, is installed at the lower back surface of embodiment 10 in the same manner as already explained above regarding plate 76. In this manner, the mounting section 20 of embodiment 10 is created by placing of first, second and third panels 21-23 in an aligned position and securing them with elongated plates 75 and 76, regardless of the fact that none of the said panels are physically interconnected. First and second joining plates 75 and 76 are made preferably of aluminum or any other suitable material such as steel, stainless steel, brass, plastic and the like.

The described connection of the first and third panels 21 and 23 to the base 15 and the described holding of the panels 21-23 in an aligned position allows a smooth sliding movement of the whole mounting section 20 from left to right in relation to base 15 and vice versa, relative to the proximal end 15 of base 15, see arrows 81 and 82 in FIG. 2. Similarly, it also allows the movements of the complete mounting section 20 inwardly and outwardly, relative to the distal end of the base 15, see arrows 83 and 84 on FIG. 3. Potential additional panels may be inserted and aligned between the panel 21 and panel 23 in embodiments within the scope of the instant invention in order to increase the area of mounting section 20. Mounting section 20 may also be increase or decrease by increasing or decreasing the width of panels 21, 22 and 23, respectively. The herein described mounting section 20 may be conveniently used for mounting items such as garments or fabrics onto it and to accurately and repetitively positioning dual hoops embroidery assemble in fabrics or items of large size, such as shirts, blouses and T-shirts and similar large size items, as described below. Contoured distal end of mounting section 20 simulates a human upper section for convenience in the embroidering garments such as shirts, dresses, t-shirts, blouses and the like; nonetheless said shape may be vary within the scope of the invention in order to facilitates the embroidering of other type of garments. Column of numerals 11 and 12 positioned on first panel 21 and 23, respectively; and a row of letters 14, positioned at the top side of the mounting section 20 constitute a positional coordinates system that are highly useful in determining or identifying a particular position on the area of the mounting section 20, as well as a particular area of a given garment, wherein the inner part of a dual hoop assemble will be positioned in order to set a predetermined section of the item to be embroidered. Said coordinates system is essential in achieving an excellent accuracy and reproducibility in positioning embroidery on the same position of group of same type of items.

As illustrated, for instance in FIGS. 5 and 6, embodiment 10, also comprises a first lateral support section 85 and a second lateral support section 86, which are positioned in an aligned and parallel position with regard to one another and have the same components or parts.

Regarding the first lateral support section 85, it is positioned at the extreme left side of the panel 21 and it is aligned to the mounting section 20. It comprises an elongated bar 87, a bar support unit 88, a first sliding unit 89 and a second sliding unit 90. The elongated bar 87 comprises a cylindrical elongated body having a straight first end 91 and a curved end 92, that is inserted in the opening or hole 32 on its left side 30 of panel 21. Bar support unit 88 has a rectangular main body having two openings passing through it, from which it is fastened onto the cutoff located at the lower left corner of first panel 21 using screws 96. It also comprises a cavity 97, wherein the straight first end 91 of the elongated bars 87 is inserted in order for said elongated bar 87 to be firmly supported.

Sliding units 89 and 90 are identical. Each one of them comprises a main rectangular body, that comprises a hole 93, passing through said main body, and a lateral threaded aperture 94, which is in direct communication with and is in perpendicular position to centered hole 93. As illustrated in at least FIGS. 1, 2 and 3, cylindrical elongated body of the elongated bar 87 is inserted though the centered holes 93 of sliding units 89 and 90 respectively, wherein they remain confined. As illustrated in FIGS. 1, 2, 8 and 9, knurled screws 95 are fastened into lateral threaded aperture 94 and tightening until end of screws 95 are in contact with the elongated bar 87, in such a manner that the sliding unit 89 and 90 are locked in a given position of said cylindrical elongated body of said elongated bar 87, as illustrated particularly in FIG. 9. In order to change the position of sliding units 89 and/or 90 to another position on said elongated bar 87, screw(s) 95 are loosening; the sliding unit is slide to the predetermined position and firmly tightening to said new position.

Similarly, second lateral support section 86 comprises the same components, which are positioned in the same manner as already mentioned for the first lateral support section 85 but located at the right side of third panel 23. It comprises an elongated bar 87A, a bar support unit 88A, a first sliding unit 89A and a second sliding unit 90A having the same characteristics than the bar support unit 88, a first sliding unit 89 and a second sliding unit 90.

Figure 8:
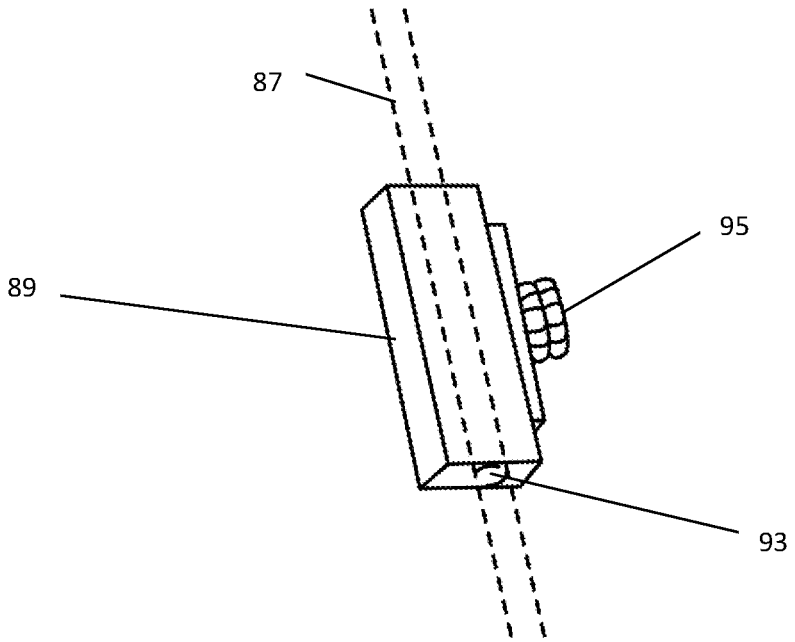
FIGS. 8 and 9 show details of holding sliding units along elongated bar in place in some embodiments according to the invention.
Figure 9:
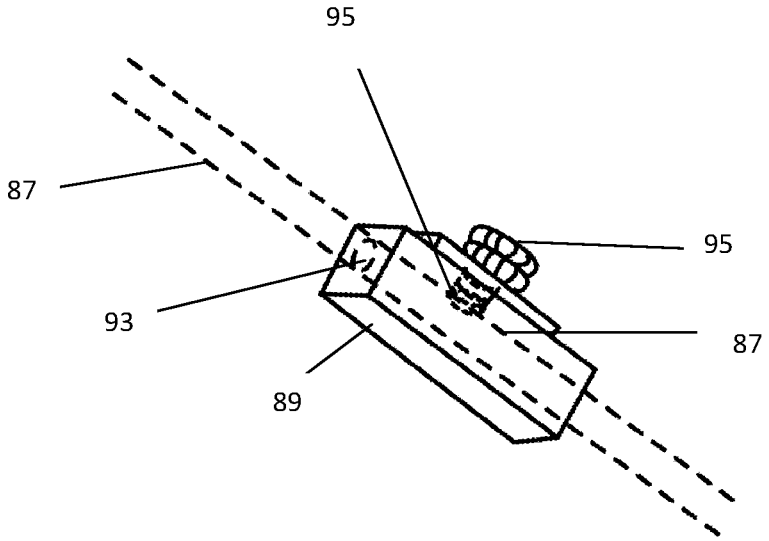

As previously indicated for the first lateral support parts: the elongated bar 87A comprises a cylindrical elongated body having a straight first end 91A and a curved end 92A, that is inserted in the opening or hole 49 on the right side 48 of panel 23. Bar support unit 88A has a rectangular main body having two openings passing through it, from which it is fastened onto the cutoff located at the lower right corner of third panel 23 using screws 96A. It also comprises a cavity 97A, wherein the straight first end 91A of the elongated bar 87A is inserted in order for said bar 87A to be firmly supported. Likewise sliding units 89 and 90, sliding units 89A and 90A are identical. Each one of them comprises a main rectangular body, that comprises a centered hole 93A, passing through said main body, and a lateral threaded aperture 94A, which is in direct communication with and is in perpendicular position to centered hole 93A. As illustrated in at least FIGS. 1,2 5 and 7, cylindrical elongated body of the elongated bar 87A is inserted through the centered holes 93A of sliding units 89A and 90A, wherein they remain confined. As illustrated in FIGS. 8 and 9, screws 95A are fastened into lateral threaded apertures 94A and tightening until end of screws 95A are in contact with the elongated bar 87A, in such a manner that the sliding unit 89A and 90A are confined in a given position of said cylindrical elongated body of said elongated bar 87A, as illustrated in FIGS. 8 and 9. In order to re position sliding units 89A and/or 90A to another position along said elongated bar 87A, screw(s) 95A are loosened, the sliding units are slide to the predetermined position on 87A and further tightening to said new position. Elongated bars 87 and 87A, bar support units 88 and 88A, and sliding units 89, 89A, 90 and 90A are preferably made of aluminum or any other suitable materials such as steel, stainless steel, brass, plastic and the like.

Figure 7:
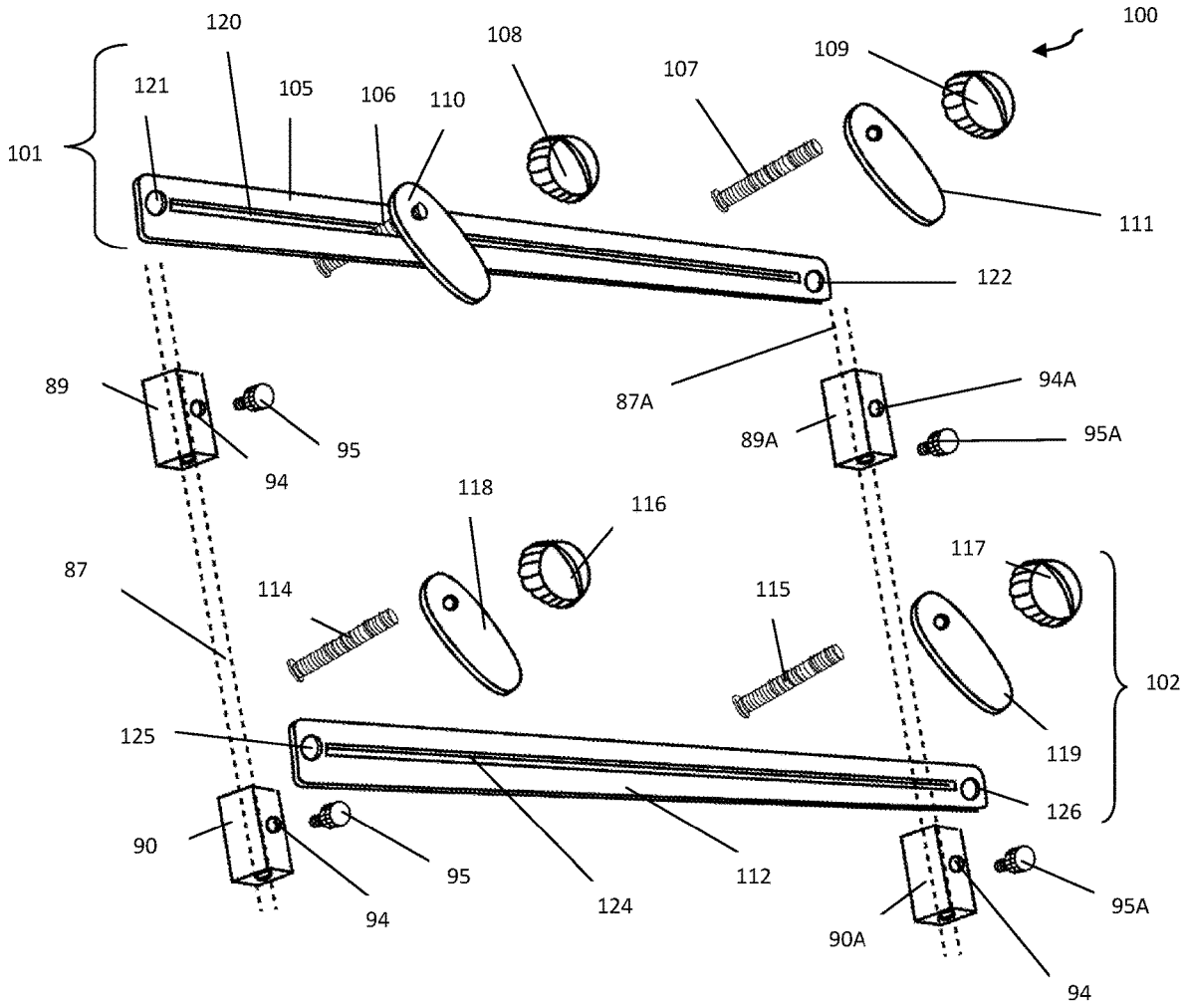
FIG. 7 illustrates views of different parts of the embodiments according to the invention that are used in firmly holding and positioning the inner part of a dual hoop assemble in any predetermined location of the mounting area.

Embodiment 10 also comprises inner hoop supporting section 100, illustrated independently or disconnected from embodiment 10 in FIG. 7. Said inner hoop support section 100 comprises a first subsection 101 and a second subsection section 102. The first subsection 101 of the inner hoop support 100 comprising an elongated plate 105, two knurled screws 106 and 107, two knurled screw handle knob 108 and 109 and two brackets units 110 and 111. Similarly, the second subsection 102 comprises an elongated plate 112, two knurled screws 114 and 115, two knurled screw handle knob 116 and 117 and two brackets units 118 and 119. As shown in FIG. 7 both subsections 101 and 102 of the inner hoop support section 100 have identical parts that are connected in the same manner. First subsection 101 is assembled above the second subsection relative to the upper and lower parts of the front surface of mounting section 20. Regarding the elongated plate 105 of said first inner hoop supporting subsection section 101, as illustrated in at least FIGS. 1, 2 and 18A, it is horizontally positioned on the front surface of mounting section 20 and it comprises a flat elongated body having groove 120, and two holes 121 and 122 located at the near end of the elongated body. Meanwhile, knurled screw 106 and knurled screw 107 are inserted throughout groove 120, with their head sections positioned in between the surface of the mounting section 20 and the interior of the elongated plate 105, while their threaded sections coming outwardly from groove 120, facing away from the mounting section 20.

Bracket units 110 and 111 are inserted into threaded section of knurled screw 106 and 107, respectively. Said brackets 110 and 111 are further secured to elongated plate 105 by tightening screw handle knobs 108 and 109 to threaded section of knurled screws 106 and 107, respectively. As expected, by loosening up handle knobs 108 and 109, brackets 110 and 111 are allow to be rotated 360 degrees around knurled screws 106 and 107, respectively. On the other hand, such loosening also allows bracket units 110 and 111 to be moved horizontally throughout groove 120. On the other hand, tightening handle knobs 108 and 109, locks said brackets 110 and 111 to a specific location along groove 120. Furthermore, first inner hoop support subsection 101 is connected to the first lateral support section and the second lateral support section by inserting knurled screws 95 and 95A via holes 121 and 122, respectively, on elongated plate 105 and further inserting and tightening said screws 95 and 95A on threading holes 94 on the sliding units 89 and 90, respectively. In this manner, elongated plate 105 is secured on mounting section 20, as illustrated in FIGS. 1 and 2.

Thus, loosening up said knurled screws 95 and 95A, allows the whole first subsection 101 of the inner hoop supporting section 100—including first and second brackets 107 and 108—to move vertically along the elongated bars 87 and 87A, what is the same to say that it moves upwardly or downwardly along the front surface of mounting section 20. On the contrary, tightening said knurled screws 95 and 95A, respectively, locks and confines the first subsection 101 of the inner hoop supporting section 100—including first and second brackets 110 and 111—onto a particular predetermined position on the mounting section 20, which is the same to said, such tightening hold the first subsection 101 onto a particular and predetermined position along the elongated bars 87 and 87A.

As illustrated in FIGS. 1, 2 and 7 and as already mentioned above, second inner hoop supporting subsection 102 comprises the same parts as the upper inner hoop supporting section 101 and said parts are connected or assembled in the same manner already explained above regarding the parts of the first inner hoop supporting subsection 101.

Similarly, the second subsection 102 comprises an elongated plate 112, two knurled screws 114 and 115, two knurled screw handle knob 116 and 117 and two brackets units 118 and 119. As shown in FIG. 7 both subsections 101 and 102 of the inner hoop support section 100 have identical parts that are connected in the same manner. First subsection 101 is assembled above the second subsection relative to the upper and lower parts of the front surface of mounting section 20.

The elongated plate 112 of said second inner hoop supporting subsection section 102, which is horizontally positioned on the front surface of mounting section 20, comprises a flat elongated body having groove 124, and two holes 125 and 126 located at the near end of the elongated body. Meanwhile, knurled screw 114 and knurled screw 115 are inserted throughout groove 124, with their head sections positioned in between the surface of the mounting section 20 and the interior of the elongated plate 124 and their threaded sections coming outwardly from groove 124 and facing away from the mounting section 20. Brackets 118 and 119 are inserted into threaded section of knurled screw 114 and 115, respectively. Said brackets 118 and 119 are further secured to elongated plate 112 by tightening screw handle knob 116 and 117 to threaded section of knurled screws 114 and 115, respectively. As expected, by loosening up handle knobs 116 and 117, brackets 118 and 119 may be rotated 360 degrees around screws 114 and 115, relatively. Such loosening also allows bracket units 118 and 119 to be moved or slipped horizontally throughout groove 124. On the other, tightening handle knobs 116 and 117, locks said brackets 118 and 119 to a specific location along groove 124.

Furthermore, inner hoop support second sub section 102 is connected to the first and second lateral support sections 85 and 86 by inserting screws 95 and 95A through openings 125 and 126 on elongated plate 112 and further fastening said screws 95 and 95A to the threaded holes 94A on sliding units 89A and 90A, respectively. Thus, loosening up knurled screws 95 and 95A, allows the whole second subsection 102 of the inner hoop supporting section 100—including brackets 118 and 119—to move vertically along elongated bars 87 and 87A, in other words, upwardly or downwardly along the front surface of mounting section 20. On the contrary, tightening said knurled screws 95 and 95A, locks or confines the second subsection 102 of the inner hoop supporting section 100—including brackets 118 and 119—onto a particular predetermined position on the mounting section 20, which is the same to said, that said tightening holds the second subsection 102 onto a particular and predetermined position along the elongated bars 87 and 87A.

Figure 18A:
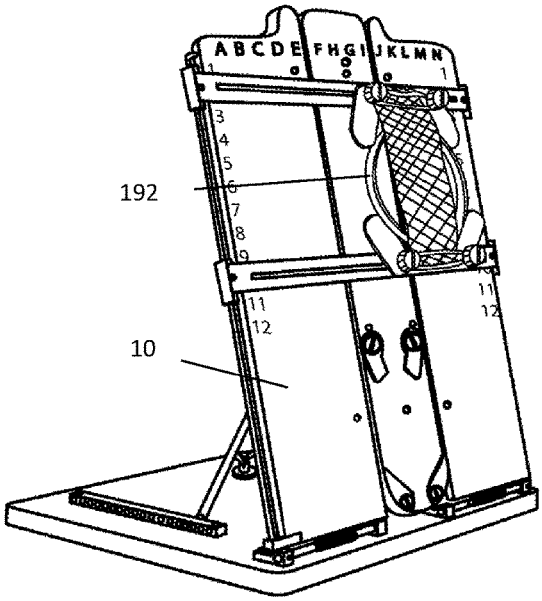
FIGS. 18A-18D illustrate the use of one embodiment according to the invention, wherein a large size item is mounted onto a dual hoop embroidering assemble.

Since first inner hoop support subsection 101 and second inner hoop support subsection 102 may be positioned in a predetermined position up or down over mounting section 20; and since all brackets 110, 111, 118 and 119 may be rotated around knurled screws 106, 107, 114 and 115, respectively, or may be slipped horizontally along or throughout grooves 112 and 124, respectively, an inner part of an embroidering hoop assemble regardless of its shape, such as the ones illustrated in FIGS. 18A and 18, may be held by said brackets 110, 111, 118 and 119 at any predetermined position on the mounting section 20. Said predetermined position may be precisely marked or identified using the system of columns of numeral 11 and 12 and letter row 14, located at the left, right and center sides of the first mounting section 20, respectively. As a consequence, a inner section of any dual embroidering hoop assemble may be positioned and lock or confined within the brackets 110, 111, 118 and 109 with excellent accuracy on the specific and predetermined position of the mounting section 20 and specific location of the embroidery on any given item group as explained below. Elongated plates 105 and 112 are preferably made of aluminum or any other suitable materials such as steel, stainless steel, brass, plastic and the like. Bracket units 110, 111, 118 and 119 are made of acrylic or any other suitable material such as aluminum, brass or plastic.

Figure 10:
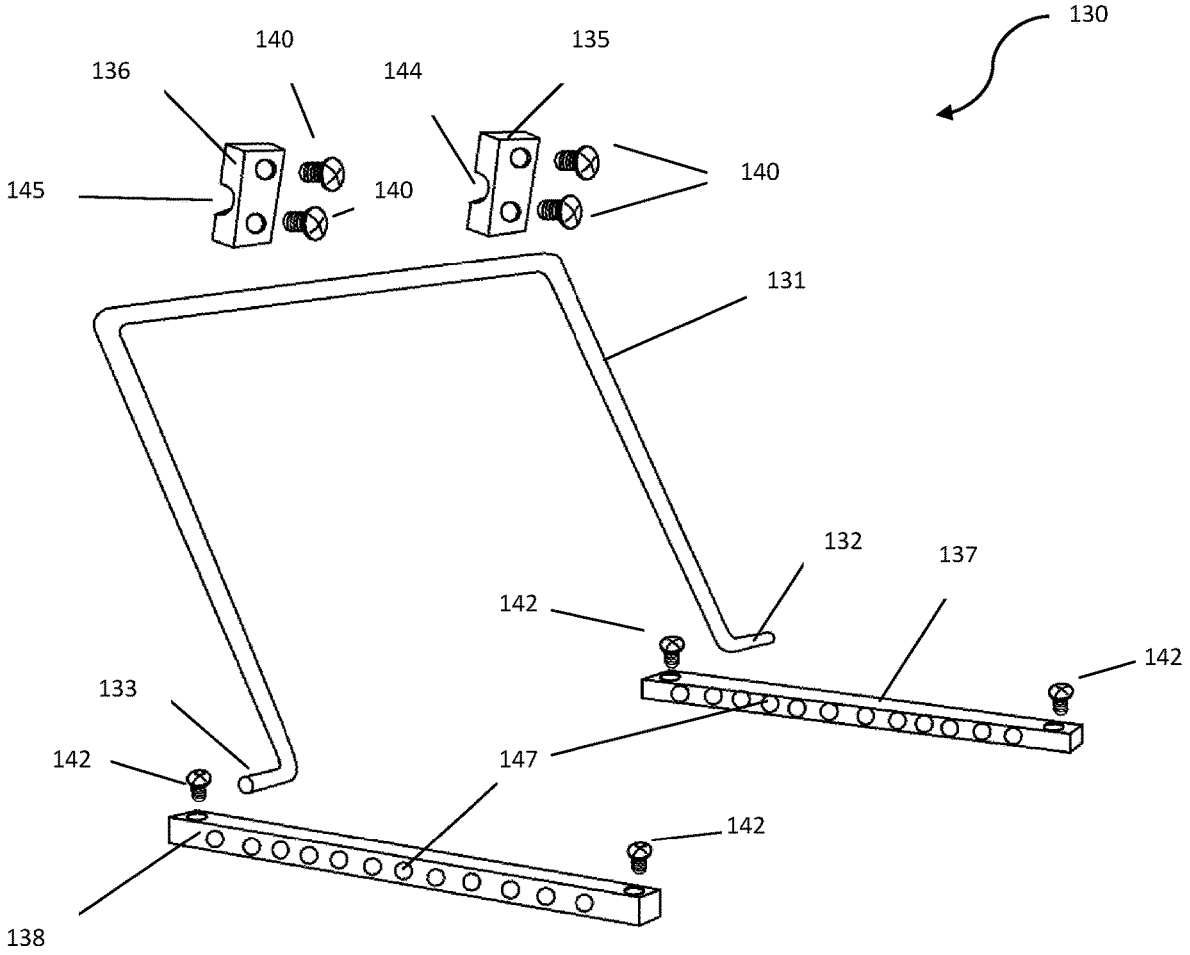
FIG. 10 illustrates the components of the support section used in order to provide an open configuration in different angled positions in embodiments according to the invention.

As mentioned previously, FIG. 1 shows the embodiment of the invention in a compacted or closed configuration, wherein the mounting section 20 and all the parts of the apparatus assembled on said mounting section 20 are semi superimposed on the flat upper surface 16 of the base 15. On the other hand, FIGS. 2 and 3 show the embodiment 10 of the invention in an open, non-compacted configuration, wherein the mounting section 20 and all the parts of the embodiment 10 assembled to said mounting section 20 are positioned in a predetermined angled position with respect to base 15. Said angled position is achieved by means of the angled rearward support section 130, which is illustrated already assembled in FIG. 3 and is shown unassembled in FIG. 10. It comprises inverted U-shaped cylindrical bar 131 having a first angled end 132 and a second angled end 133; a first bar holding clamp 135, a second bar holding clamp 136, a first multi perforated bar 137 and a second multi perforated bar 138.

As illustrated in FIG. 3, first and second bar holding clamps 135 and 136 are fastened to first and third panels 21 and 23, respectively, by means of screws 140. Inverted U-shaped cylindrical bar 131 is confined inside said first and second holding clamps 135 and 136 via semi round cutoff 144 and 145 on the main body of said holding clamps. However, even though inverted U-shaped bar 131 is confined into holding clamps 135 and 136, it is allow to rotate freely within said clamps 135-136. The ends 132 and 133 are inserted in a set of aligned perforations or openings 147 of the first and second multi perforated bars 137 and 138, which are fastened to the top surface 17 of base 15 by means of screws 142. In this manner, after selecting a given predetermined angle, the User may set the mounting section 20 of embodiment 10 and firmly securing it in said predetermined angle by inserting ends 132 and 133 of the inverted U-shaped bar 131 into a preselected pair of aligned perforations 147 on the multi perforated bars 137 and 138. U-shaped cylindrical bar 131, first and second bar holding clamp 135 and 136 and first and second multi perforated bar 137, 138 are preferably made of aluminum or any other suitable materials such as steel, stainless steel, brass, plastic and the like.

Figure 11:
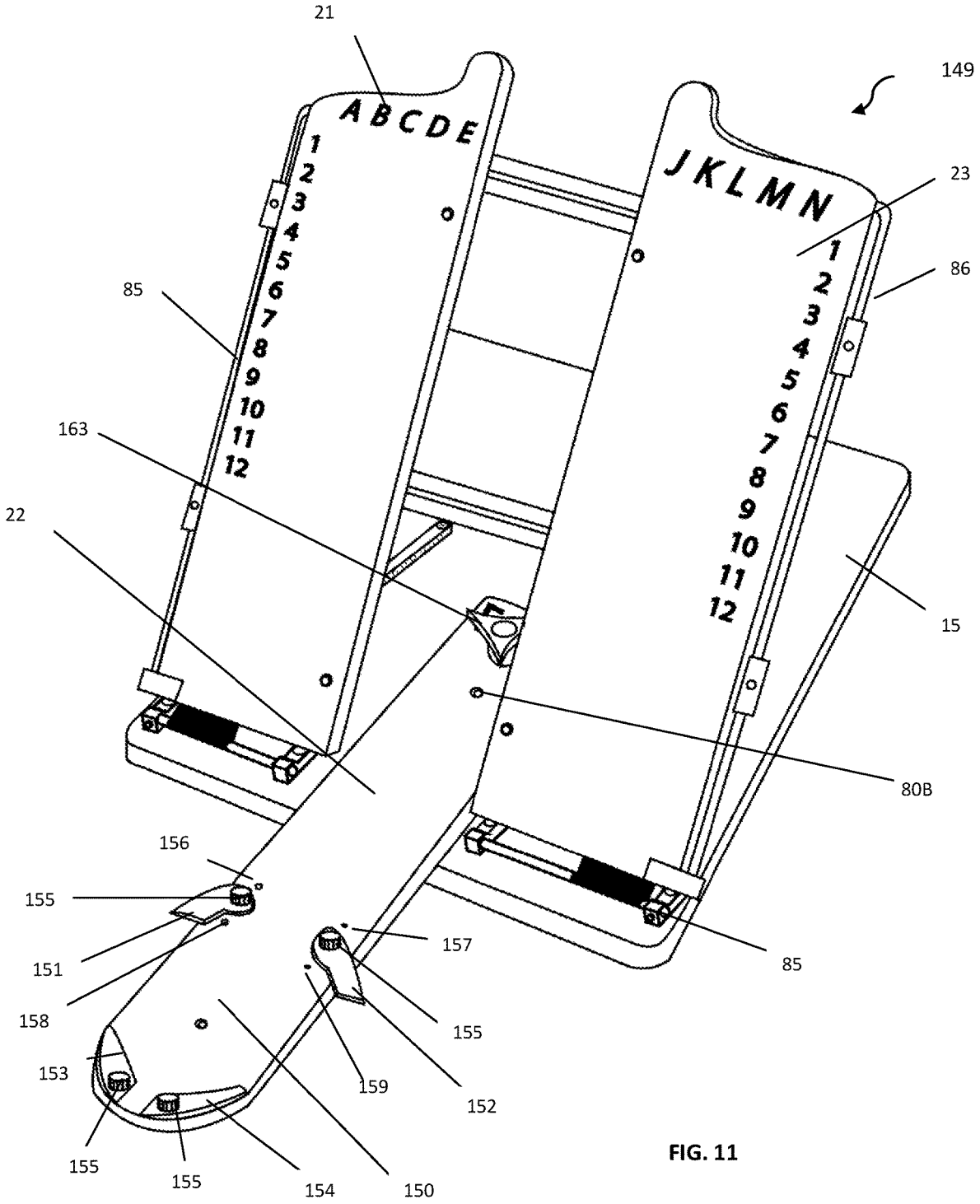
FIG. 11 is a perspective view of an embodiment according to the invention, illustrating an alternative mounting section conveniently used in positioning a dual hoop assembles in small size items.

FIG. 11, illustrates embodiment 149, which comprises an alternative functional configuration of embodiment 10. It comprises a second mounting section 150, which is located at the proximal end 36 and front surface 34 of the second panel 22. Mounting section 150 comprises four knurled screws 72, first inner hoop holding bracket 151, second inner hoop holding bracket 152, third inner hoop holding bracket 153, fourth inner hoop holding bracket 154 and four knurled screw handle knobs 155.

As illustrated in at least FIG. 3, four knurled screws 72 are fastened from the back surface 35 of panel 22, thus, the threaded section of said knurled screws are exposed on the front surface 34 of said panel 22. Each holding bracket 151, 152, 153 and 154 are then inserted into each one of the threaded sections of screws 72, and after tightening a knurled screw handle knob 155 on each one of the knurled screws 72, mounting section 150 is completed.

Said mounting section 150 also comprises holes 156-159, which may be conveniently used in order to increase the area of mounting area 150 by relocating knurled screws 72, inner hoop holding brackets 151 and 152 to holes 156 and 157, respectively. Alternatively, mounting area 150 may be conveniently decrease in size by relocating knurled screws 72, inner hoop holding brackets 151 and 152 to holes 158 and 159, respectively. In this manner the versatility of the embodiment 149 is further increased since the mounting area 150 may be used to hold inner hoop sections of different sizes and thus facilitates the embroidering process of different small size items or garments such as sock, sleeves, caps and the like.

The embodiment 149 illustrated in FIG. 11 may be easily obtained from embodiment 10, after removing screws 80B on panel 22, illustrated in FIG. 3, thus allowing the second panel 22 to be removed from mounting section 20 and further laying down said panel 22 in between the first panel 21 and third panel 23 and on upper surface 16 of base 15; and further positioning screw 80B used to hold panel 22, into opening 161 on the upper section 16 of base 15 and inserting knurled screw 162 on base 15 into hole 42 on second panel 22 and further tightening it with knurled handle knob 163 in order to increase the stability and firmness to the second panel 22 to base 15.

Inner hoop holding brackets 151-154 may be rotated freely once the knurled screw handle knobs 155 are loosened and may be set or secured in a given and predetermined position once said knurled screw handle knob 155 are tightened up. While mounting section 150 is included in embodiment 10 as illustrated in FIGS. 1 and 2, its functionality is achieved by changing the configuration of embodiment 10 to the configuration of embodiment 149, illustrated in FIG. 11. The presence of mounting section as illustrated in FIGS. 1 and 2 has no adverse functionality effect nor it reduces the sizes of mounting section 20 in embodiment 10. The scope of the instant invention includes embodiment 10 with or without mounting section 150. The main function of said alternative mounting section 150 is to firmly hold the inner part of a dual hoop embroidering assemble of any geometry or shape, in order to position said inner hoop part in small size items that are going to be embroidered or subjected to similar processes; for instance: caps, socks, sleeves of t-shirts, shirts, or blouses, babies clothes and the like, as explained and illustrated below. Bracket units 151-154 are made of acrylic or any other suitable material such as aluminum, brass or plastic.

Figure 12:
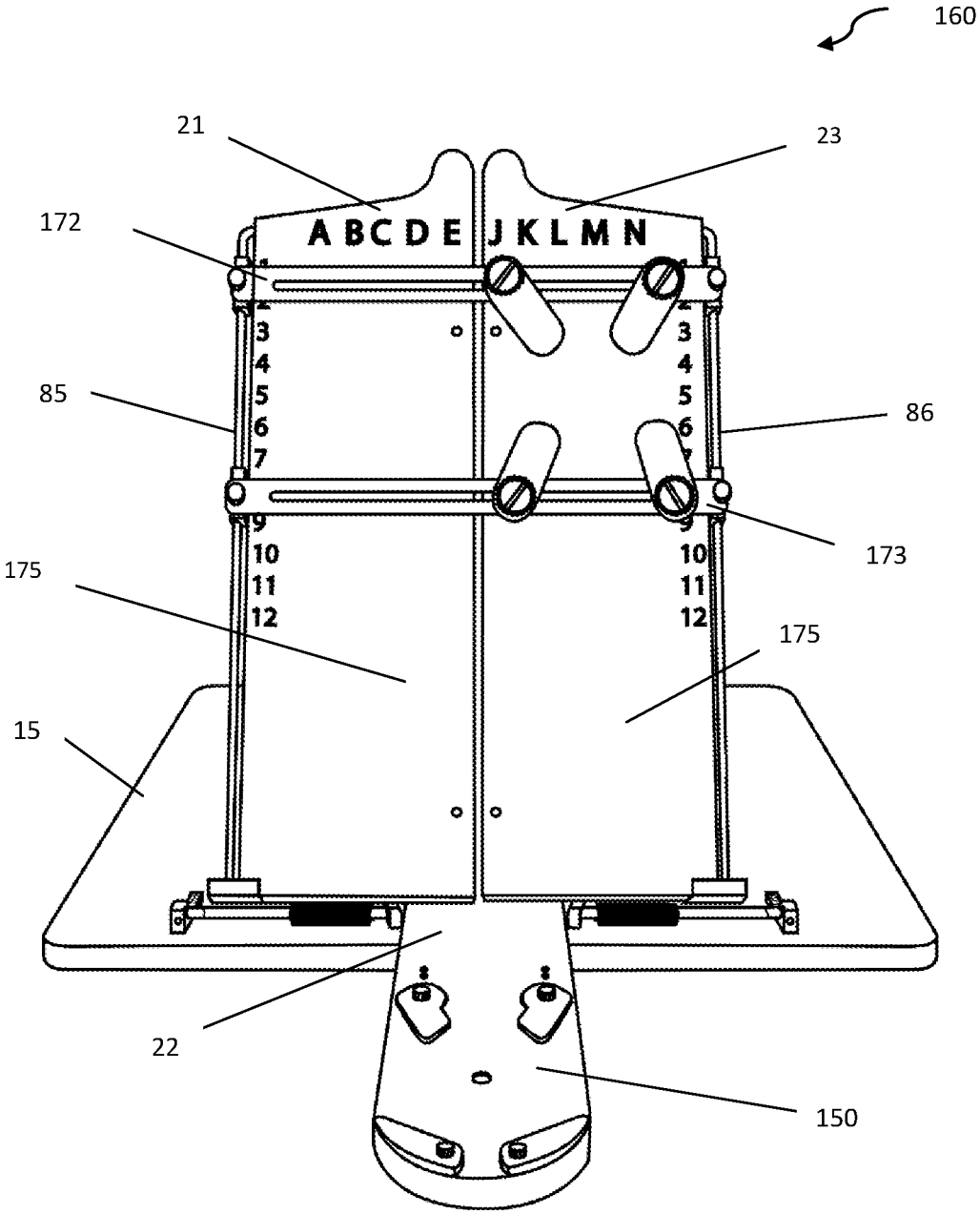
FIG. 12 is a front view of an embodiment according to the invention showing two alternative mounting sections: one conveniently used in positioning an inner part of a dual hoop assemble in medium size items and another for positioning such inner hoop part in small items.

Embodiment 160 is illustrated in FIG. 12. It is created from embodiment 149, by simply pushing first and third panels 21 and 23 inwardly until they are next to one another and installing elongated bars 172 and 173, by fastening screws 95 and 95A on sliding units 89, 90, 89A and 90A as previously explained above while discussing details of embodiment 10. Elongated bars 172 and 173, as illustrated in FIG. 12, are shorter that elongated plates 105 and 112, nonetheless in any other sense they have the same characteristics already discussed for plates 105 and 112. Embodiment 160 presents two mounting sections, mounting section 150, located on proximal end 36 of panel 22 and a mounting section 175, which is located along the flat front surface 26 and flat front surface 43 of first panel 21 and third panel 23, respectively, as illustrated in FIG. 12. Thus, embodiment 160 comprises simultaneously mounting sections for positioning inner hoop sections of a dual embroidery assemble for small size garments in mounting section 150 as well as for medium size garments in mounting section 175.

Figure 13:
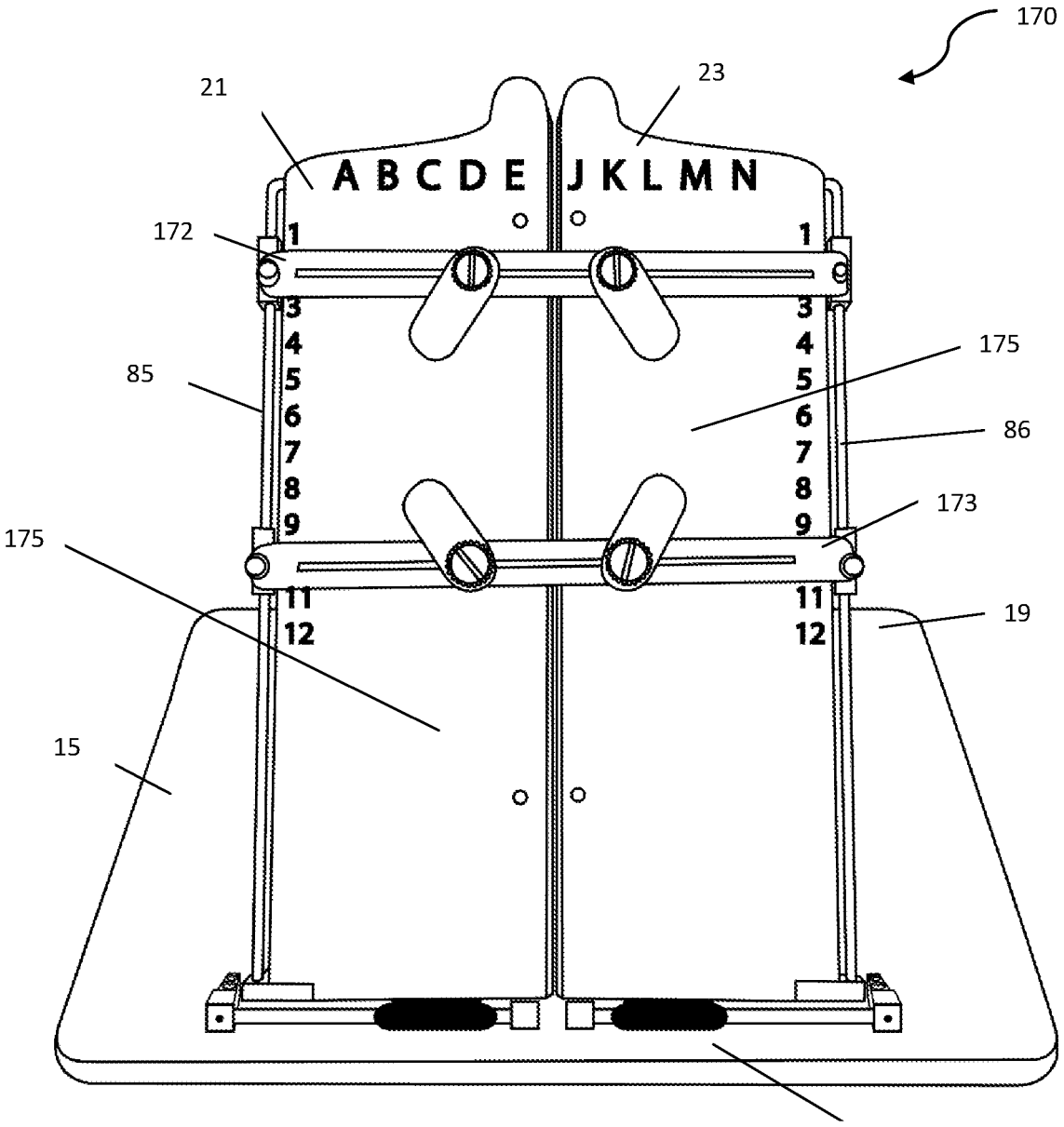
FIG. 13 is a front view of a third configuration according to the invention, illustrating a single mounting section conveniently used in positioning an inner part of a dual hoop assemble in medium size items.
Figure 14:
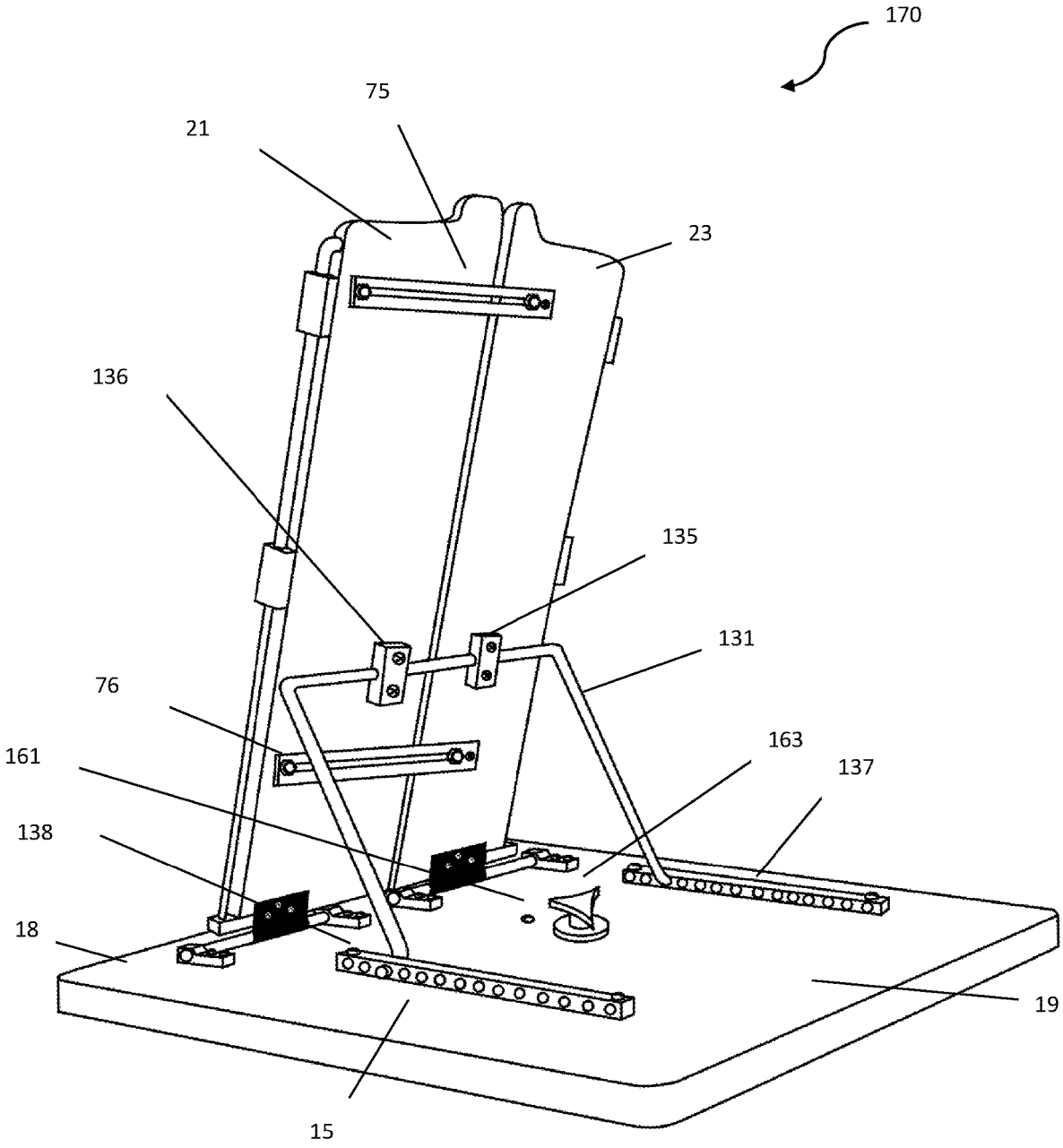
FIG. 14 is a rear view in perspective of a third configuration of the embodiment according to the invention, illustrated in FIG. 13.

FIGS. 13 and 14 show embodiment 170 according to the of the invention, which may be obtained, for example, from embodiment 10, after second panel 22 is totally extracted of the embodiment 10 by unscrewing screws 80B on panel 22, as explained above; shifting or sliding first panel 21 and third panel 23 toward each other, and substituting elongated plates 105 and 112 by shortest elongated plates 172 and 173, thus allowing the formation of a mounting section 175, which comprises first panel 22 and third panel 23. Embodiment 170 comprises all components of embodiment 10 already explained, with exception of panel 22. Said mounting section 175 functions as already described for the first mounting section 20: it is useful in holding inner parts of a dual hoop assemble in a predetermined position on the surface of embodiment 170 in order to position such inner hoop part in a specific and determined position of the item to be embroidered or subjected to similar process. Mounting section 175 is highly convenient for holding inner parts of dual embroidery assemble of any shape or geometry in order to assemble said dual hoop assemble into medium sizes items in an precise position of the item. It also provides an easy manner of positioning the embroidery on the same location on multiple identical items as the shirts of a given social or sport team since the embroidering hoops.

Figure 15A:
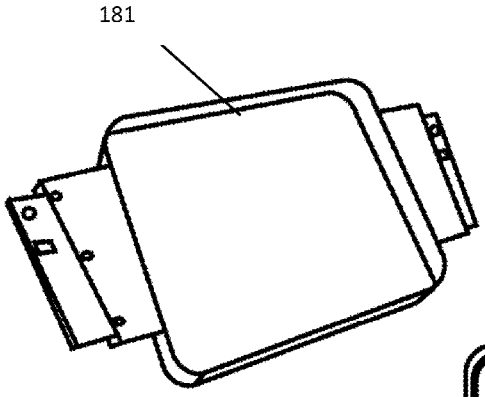
Prior Art FIG. 15A
FIGS. 15A-15C illustrate different views of a rectangular dual hoop assemble and the manner in which the inner section of such dual hoop assemble is confined in the holding brackets according to the invention.
Figure 15B:
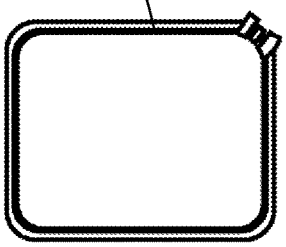
Prior Art FIG. 15B
Figure 15C:
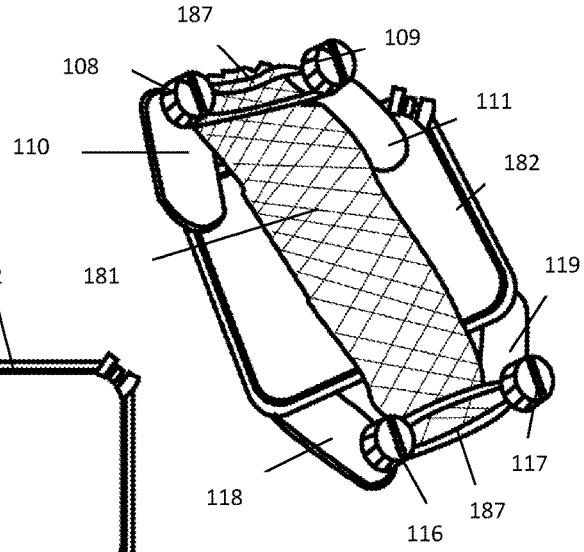

Dual hoop assembles used in the embroidering or similar process are well known in the prior art. Such hoop assembles comprises an outer section and an inner section intended to be snap into the outer section while capturing the section of the item intended to be embroidered. Some examples of such dual hoop assembles are illustrated in FIGS. 15A and 15B; 16A and 16B; and 17A and 17B. The manner in which inner sections of the dual hoop assembles having of different geometrical shapes are held using brackets 110, 111, 118 and 119 in mounting sections 20 or 175 is illustrated in FIGS. 15C 16C and 17C. For instance, In FIGS. 15A and 15B, the shape of the hoop assemble 180 is square, the outer section 181 is illustrated in FIG. 15A and the inner section 182 shown in FIG. 15B correspond to the inner section of the dual hoop assemble. In FIG. 15C it is illustrated the inner hoop part 182 of the dual hoop assemble 180 already inserted and secured in brackets 110, 111, 118 and 119 and with backing or stabilizer 188 already secured on top of the inner hoop 182 by means of rubber bands 187.

Figure 16A:
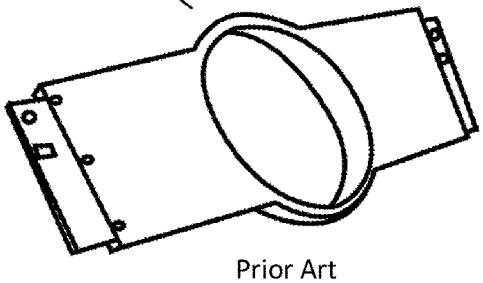
Prior Art FIG. 16A
FIGS. 16A-16C illustrate different views of a round dual hoop assemble and the manner in which the inner section of such round dual hoop assemble is confined in the holding brackets according to the invention.
Figure 16B:
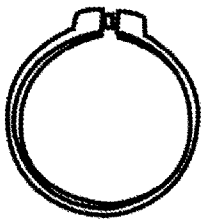
Prior Art FIG. 16B
Figure 16C:
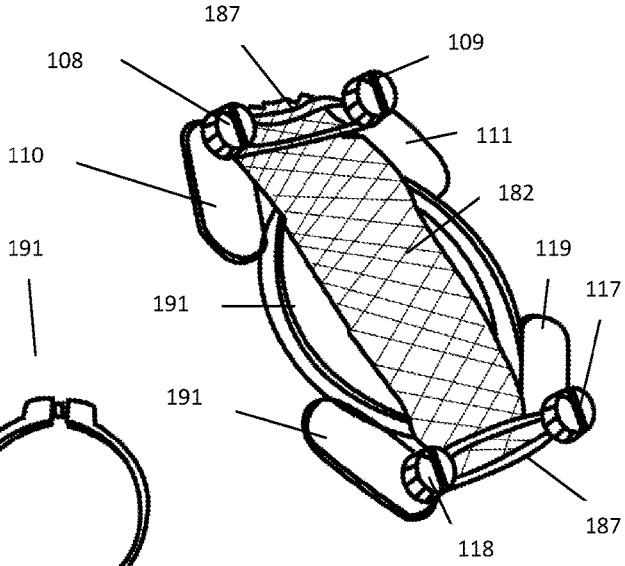

Similarly, outer section 191, illustrated in FIG. 16A and inner section 192, shown in FIG. 16B correspond to the individual parts of round dual hoop assemble 190. Inner part 192 is configured to be snap inside the outer section 191. FIG. 16C illustrates the inner hoop part of the dual hoop assemble 192 already inserted and secured in brackets 110, 111, 118 and 119 and with backing or stabilizer 188 already secured on top of the inner hoop 192 by means of rubber bands 187.

Figure 17A:
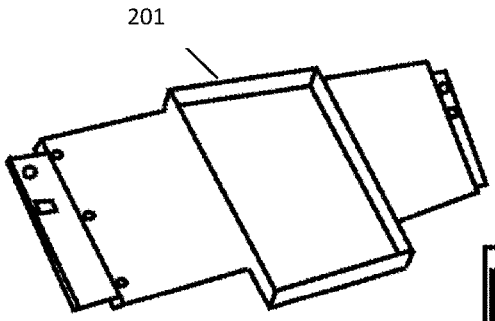
Prior Art FIG. 17A
FIGS. 17A-17C illustrate different views of a square dual hoop assemble and the manner in which the inner section of such round dual hoop assemble is confined in the holding brackets according to the invention.
Figure 17B:
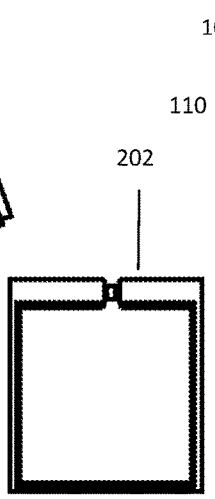
Prior Art FIG 17B
Figure 17C:
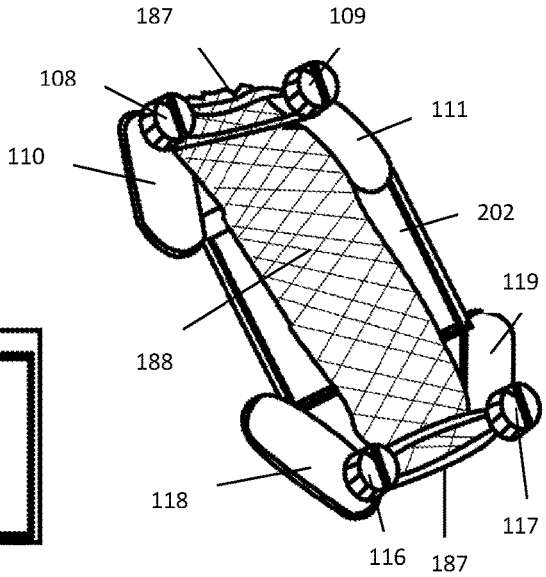

Likewise, in FIG. 17A is illustrated the outer section 201, while in FIG. 17B is shown the corresponding inner section 202 of the rectangular dual hoop assemble 200. FIG. 17C illustrates the inner hoop 202 of the dual hoop assemble 200 already inserted and secured in brackets 110, 111, 118 and 119 and with backing or stabilizer 188 already secured on top of the inner hoop section 202 by means of rubber bands 187.

Figure 18B:
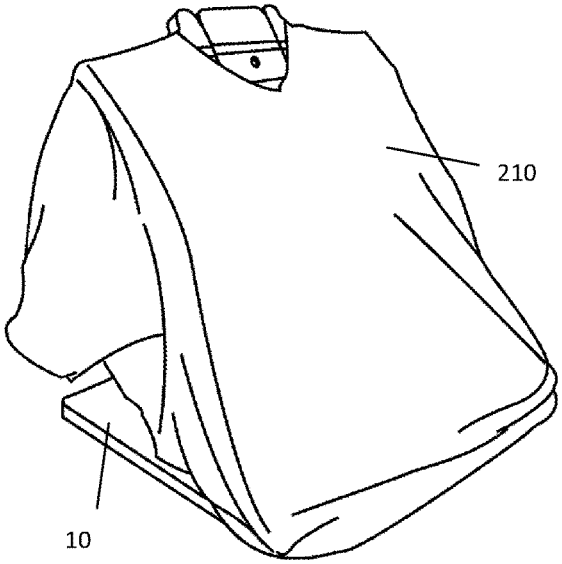
Figure 18C:
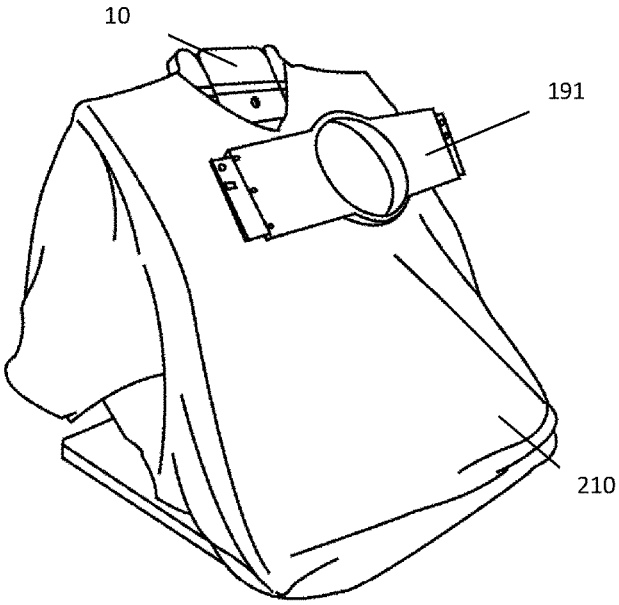
Figure 18D:
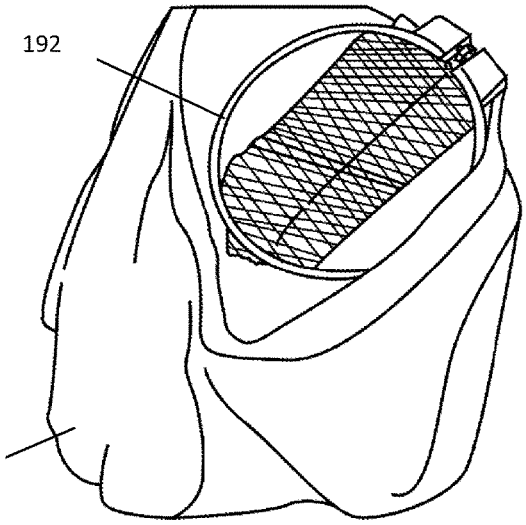

FIGS. 18A to 18D, illustrate, in operative terms, the manner of using mounting sections 20 of embodiment 10, in the process of precisely positioning embroidering hoops in an item to be embroidered using a dual hoop embroidering assemble. As illustrated in FIG. 18A, inner hoop section is shown secured by holding brackets 110, 111, 118 and 119 once the first and second inner hoop holding subsections 101 and 102 are positioned and secured at predetermined position of the mounting section 20. First and second inner holding subsections 101 and 102 are positioned in a predetermined position by means of loosening or tightening knurled screws 95 and 95A on sliding units 89, 90 and 89A and 90A respectively, and moving up or down elongated plates 105 and 112 along the elongated support bars 87 and 87A until positioning said elongated plates 105 and 112 in the predetermined and desired vertical position on the mounting section 20. Subsequently, by loosening and tightening knurled screw handle knobs 108, 109, 116 and 117, brackets 110, 111, 118 and 119 are positioned at a predetermined and desired horizontal position along the plates 105 and 112. Rotation of brackets 110, 111, 118 and 119 are then used in order to hold and firmly secure the inner hoop section 192. If desired or required, the backing or stabilizer 188 is then positioned on top of the inner hoop 192 and further secured using rubber bands 187. Once the inner hoop part is firmly secured, garment 210 is inserted and spread out in mounting section 20 having the inner hoop section 192 already set, as illustrated in FIG. 18B. As illustrated in FIG. 18C, the outer hoop section 191 is then placed over the section of the garment 210, particularly on the section of the garment covering the inner hoop section 192 and then it is inserted or snap onto the inner hoop section 192, thus snapping the section of the garment 210 that will be embroidered. In this manner, the section to be embroidered of the garment 210 is taut and confined between the outer hoop section 191 and the inner hoop section 192, as illustrated in FIG. 18D.

Numerals columns 11 and 12 at the left and right sides of the mounting area and letters row 14 on top of the front side of the mounting area 20 are conveniently used as coordinates in order to identified and select the desired and predetermined position on the mounting area wherein the inner hoop part 192 must be positioned or to properly select the embroidering area on a given fabric item.

Figure 19A:
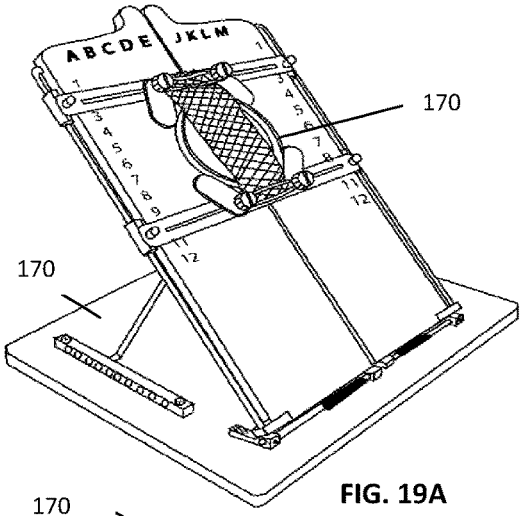
FIGS. 19A-19D illustrate the use of one embodiment according to the invention in the mounting of a medium size of an item onto a dual hoop embroidering assemble.
Figure 19B:
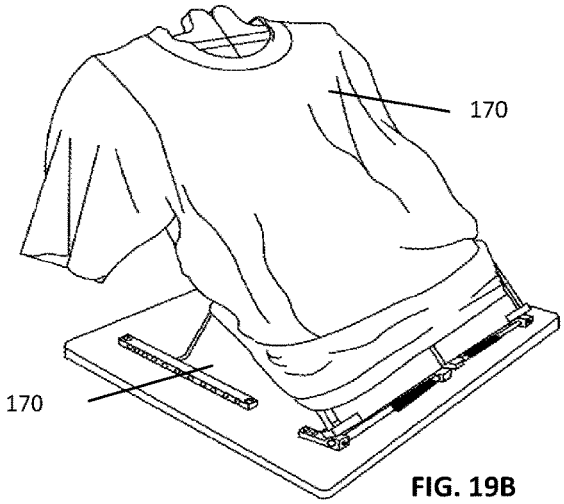
Figure 19C:
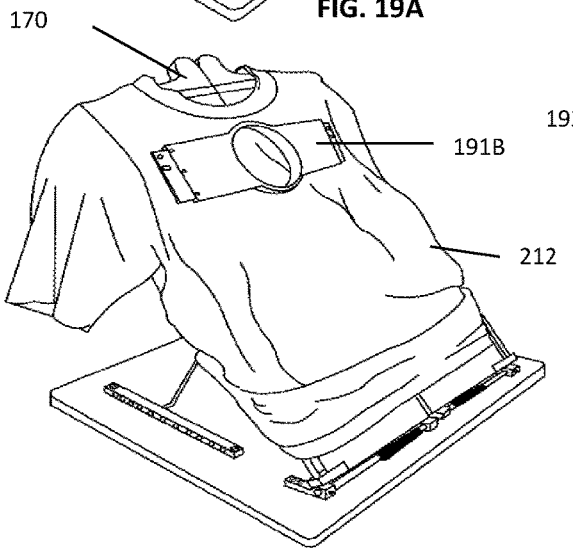
Figure 19D:
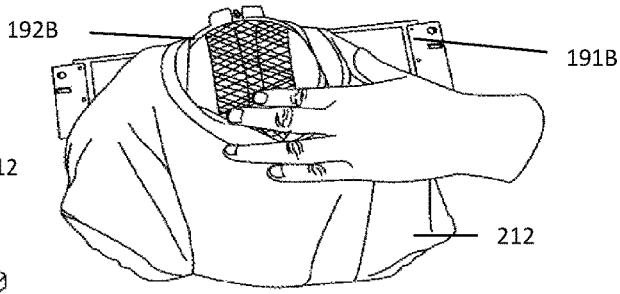
Figure 20A:
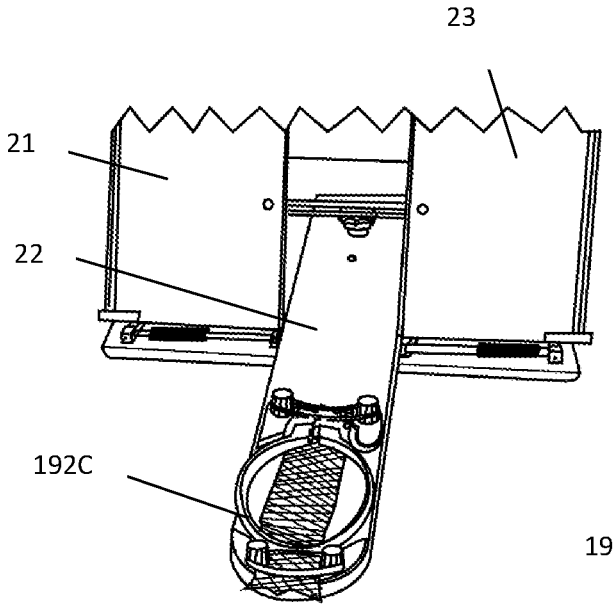
FIGS. 20A-20C illustrate the use of the apparatus according to the invention in the mounting of a small size of an item onto a dual hoop embroidering assemble.
Figure 20B:
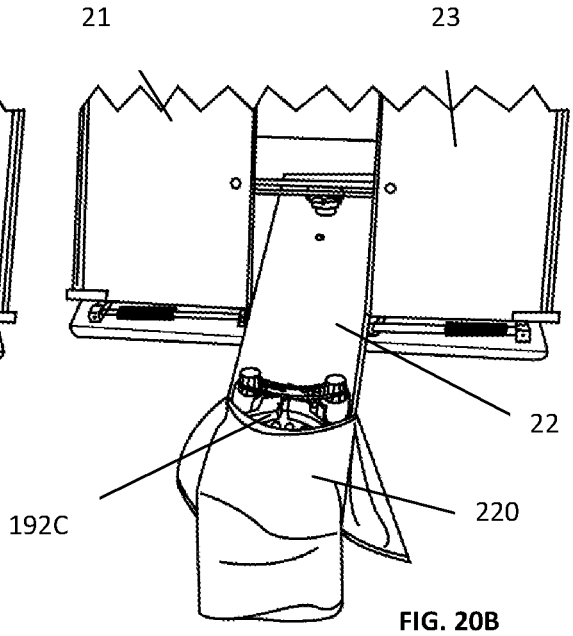
Figure 20C:
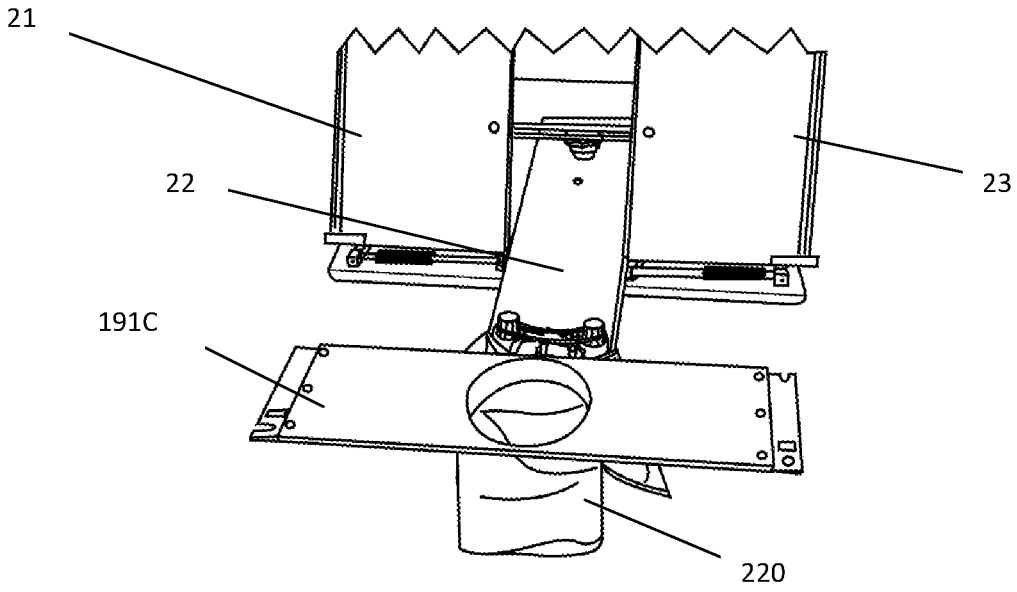

In practical terms, the same process explained above in the use of embodiment 10 is illustrated in FIGS. 19A, 19B, 19C and 19D, in order to use mounting section 175 of embodiment 170 and using a dual hoop assemble 190B, which is round but smaller than the dual hoop assembled 190. Contrary to the larger garment 210, the garment 212 illustrated in FIG. 19B is a medium size garment. After inner hoop assemble section 191B is placed on mounting section 175, the garment 212 is set on the embodiment 170 and the outer section of a dual hoop embroidery assemble is snap into inner section 192B, as illustrated in FIGS. 19C and 19D. Likewise, FIGS. 20A, 20B and 20C illustrate the use of mounting section 150 of embodiment 149 in mounting a dual hoop assemble 190C, which is round but smaller that the dual hoop assemble 190B onto a small baby shirt 220, use therein as example of the item to be embroidered. FIG. 20A illustrates inner hoop section 192C already firmly secured into mounting section by inserting said inner hoop section in between holding brackets 151, 152, 153 and 154 by means of loosening and tightening knurled screws 155. Once the inner hoop section is set on mounting section 150, garment 220 is inserted and spread out over said mounting section 150 as illustrated in FIG. 20B. Outer hoop section 190C is then placed on and inserted into the inner hoop section, thus snapping and confining the section of garment 220 to be embroidered between the inner hoop section 192C and the outer hoop section 191C.

Finally, while the present invention has been described in terms of particular embodiments and applications, in both summarized and detailed forms, it will be understood that many substitutions, changes and variations in the described embodiments, applications and details of the novel tool illustrated herein and of its operation can be made by those skilled in the art to adapt it to various usages and conditions, without departing from the spirit of this invention. As such, these changes and modifications are properly, equitably, and intended to be within the full range of equivalence of the followings. While the invention has been described in conjunction with some embodiments, it is to be understood that many alternatives, modifications, and variations will be apparent to those skilled in the art in light of the forgoing description. Accordingly, the invention is intended to embrace all such alternatives, modifications and variations falling within the spirit and scope of the appended claims.

What is claim is:

1. A portable apparatus for mounting a dual hoop system for embroidery onto a section of an item to be embroidered, said apparatus comprising:

a) a base comprising a flat top surface, a flat bottom surface, a proximal end, a distal end, a left side and a right side;

b) a mounting section, said mounting section comprising:

a first panel comprising a flat front surface, a flat back surface, proximal end, a distal end, a left side, a right side and a hole on said left side;

a second panel comprising a flat front surface, a flat back surface, proximal end, a distal end, a left side and a right side;

a third panel comprising a flat front surface, a flat back surface, proximal end, a distal end, a left side, a right side and a hole on its right side;

a joining system configured to join said first, second and third panel in an aligned position, said joining system comprising a first joining plate and a second joining plate, fastened to the flat back surface of said first, second and third panel;

c) a connecting system for connecting the mounting section to the base by connecting the first and third panels of the mounting section to the proximal end of the base, said connecting system allowing the mounting section to move inwardly and outwardly in relation to the distal side of the base and from left to right and vice versa in relation to the proximal side of the base;

d) a first lateral support section, and a second lateral support section comprising:

a first sliding unit and a second sliding unit, each of said sliding units comprising a main body with a central aperture passing throughout said main body and a threaded lateral hole perpendicular to and in direct contact with said central aperture;

an elongated cylindrical bar comprising an elongated body having an angled end, which is inserted into the hole on said left side of the first panel, and a straight end; said elongated cylindrical bar positioned in parallel to the left side of the first panel, and wherein said elongated body is inserted through the central aperture of the first and second sliding units, allowing said first and second sliding units to slide upwardly and downwardly along said elongated bar;

a supporting unit comprising a rectangular body fastened to the first panel and a round cavity wherein the straight end of said elongated cylindrical bar is inserted and secured;

e) a second lateral support section, comprising:

a first sliding unit and a second sliding unit, each of said sliding units comprising a main body with a central aperture passing throughout said main body and a threaded lateral hole perpendicular to and in direct contact with said central aperture;

an elongated cylindrical bar comprising an elongated body having an angled end, which is inserted into the hole on said right side of the third panel, and a straight end; said elongated cylindrical bar positioned in parallel to the right side of the third panel, and wherein said elongated body is inserted through the central aperture of the first and second sliding units of the second lateral support section, allowing said first and second sliding units to slide upwardly and downwardly along said elongated bar of the second lateral support section;

a supporting unit, comprising a rectangular body fastened to the third panel and a round cavity wherein the straight end of said elongated cylindrical bar is inserted and secured;

f) an upper inner hoop supporting section comprising:

an elongated plate comprising a first hole, a central elongated groove and a second hole;

a first knurled screw and a second knurled screw, wherein said first and second knurled screws are inserted through the central elongated groove of the elongated plate with its threaded ends pointing outwardly relative to the mounting section;

a first knurled screw handle knob and a second knurled screw handle knob;

a first holding bracket comprising a main body with an opening inserted in the first knurled screw and further secured with the first knurled screw handle knob;

a second holding bracket comprising a main body with an opening inserted in the second knurled screw and further secured with the second knurled screw handle knob;

a third knurled screw passing through said first hole of the elongated plate and threaded to the threaded lateral hole of the first sliding unit in the first lateral support section;

a fourth knurled screw passing through said second hole of the elongated plate and threaded to the threaded lateral hole of the first sliding unit in the second lateral support section;

g) a lower inner hoop supporting section comprising:

an elongated plate comprising a first hole, a central elongated groove and a second hole;

a first knurled screw and a second knurled screw, both of them inserted though the central elongated groove of the elongated plate with its threaded ends outwardly positioned relative to the mounting section;

a first knurled screw handle knob and a second knurled screw handle knob;

a first holding bracket comprising a main body with an opening inserted in the first knurled screw and further secured with the first knurled screw handle knob;

a second holding bracket comprising a main body with an opening inserted in the second knurled screw and further secured with the second knurled screw handle knob;

a third knurled screw passing through said first hole of the elongated plate and threaded to the threaded lateral hole of the first sliding unit in the second lateral support section;

a fourth knurled screw passing through said second hole of the elongated plate and threaded to the threaded lateral hole of the second sliding unit in the second lateral support section;

h) a rearward support section which allows the mounting section to be secured in a selected angled position, said rearward support section comprising:

an inverted U-shaped bar having a first bent end and a second bent end;

a first clamp and a second clamp, fastened to the back surface of the first and second panels respectively and confining the U-shaped bar to the back surface of the first and third panels;

a first multi-perforated bar and a second multi-perforated bar; each one of said perforated bar fastened in to the base and wherein the first bent end and the second bent end of the inverted U-shaped bar are inserted in a predetermined aligned perforations on the first and second multi-perforated bars respectively in order to maintain the mounting section in an selective angled position; and wherein:

the upper and the lower inner hoop support sections are movable upwardly and downwardly along the elongated cylindrical bars on the first and second lateral support sections once the third and fourth knurled screws of the upper inner hoop support section, which are threaded to the first sliding unit in the first lateral support section and the first sliding unit of the second lateral support section, respectively, and the third and fourth knurled screws of the lower inner hoop support section, which are threaded to the second sliding unit in the first lateral support section and to the second sliding unit in the second lateral support section, respectively, are loosed; and wherein the upper and the lower inner hoop support sections are confined to a predetermined or selective position along said elongated cylindrical bars on the first and second lateral support sections once said third and fourth knurled screws of the upper inner hoop section and the third and fourth knurled screws of the lower inner hoop section, respectively, are tightened; and wherein:

the first and second holding brackets of the upper inner hoop support section are rotatable around the first knurled screw and the second knurled screw, respectively, and are also movable horizontally along the central elongated groove of the elongated plate of the upper inner hoop supporting section once the first and second knurled screw handle knobs of said upper hoop support section are loosed and wherein said first and second holding brackets of the upper inner hoop support section are selectively confined to a predetermined position along said central elongated hoop by tightening said first and second knurled screw handle knobs; and wherein the first and second holding brackets of the lower inner hoop support section are rotatable around the first knurled screw and the second knurled screw, respectively, and are also movable horizontally along the central elongated groove of the elongated plate of the lower inner hoop supporting section once the first and second knurled screw handle knobs of said upper hoop support section are loosed and wherein said first and second holding brackets of the lower inner hoop support section are selectively confined to a predetermined position along said central elongated hoop by tightening said first and second knurled screw handle knobs.

2. The apparatus as recited in claim 1, further comprising a screw with a handle knob inserted on the upper surface of the base section.

3. The apparatus as recited in claim 2, further comprising an opening on the upper surface of the base section.

4. The apparatus as recited in claim 3, further comprising a second mounting section located at the front surface and near the proximal end of the second panel, which is able to firmly support and held an inner section of a dual hoop assemble.

5. The apparatus as recited in claim 4, wherein said second mounting section comprising four holding brackets, each one of them inserted in a knurled screw and secured by a knurled screw handle knob.

6. The apparatus as recited in claim 5, wherein the central panel is relocated in a position parallel to the base, thus providing the area near the proximal end of the second panel as an embroidery positional section for small items.

7. A portable apparatus for mounting a dual hoop system for embroidery onto a section of an item to be embroidered, said apparatus comprising:

a) a base comprising a flat top surface, a flat bottom surface, a proximal end, a distal end, a left side and a right side;

b) a mounting section, said mounting section comprising:

a first panel comprising a flat front surface, a flat back surface, proximal end, a distal end, a left side, a right side and a hole on said left side;

a second panel comprising a flat front surface, a flat back surface, proximal end, a distal end, a left side, a right side and a hole on its right side;

a joining system configured to join said first and second panels in an aligned position, said joining system comprising a first joining plate and a second joining plate, fastened to the flat back surface of said first and second panels;

c) a connecting system for connecting the mounting section to the base by connecting the first and second panels of the mounting section to the proximal end of the base, said connecting system allowing the mounting section to move inwardly and outwardly in relation to the distal side of the base and from left to right and vice versa in relation to the proximal side of the base;

d) a first lateral support section, and a second lateral support section comprising:

a first sliding unit and a second sliding unit, each of said sliding units comprising a main body with a central aperture passing throughout said main body and a threaded lateral hole perpendicular to and in direct contact with said central aperture;

an elongated cylindrical bar comprising an elongated body having an angled end, which is inserted into the hole on said left side of the first panel, and a straight end; said elongated cylindrical bar positioned in parallel to the left side of the first panel, and wherein said elongated body is inserted through the central aperture of the first and second sliding units, allowing said first and second sliding units to slide upwardly and downwardly along said elongated bar;

a supporting unit comprising a rectangular body fastened to the first panel and a round cavity wherein the straight end of said elongated cylindrical bar is inserted and secured;

e) a second lateral support section, comprising:

a first sliding unit and a second sliding unit, each of said sliding units comprising a main body with a central aperture passing throughout said main body and a threaded lateral hole perpendicular to and in direct contact with said central aperture;

an elongated cylindrical bar comprising an elongated body having an angled end, which is inserted into the hole on said right side of the third panel, and a straight end; said elongated cylindrical bar positioned in parallel to the right side of the second panel, and wherein said elongated body is inserted through the central aperture of the first and second sliding units of the second lateral support section, allowing said first and second sliding units to slide upwardly and downwardly along said elongated bar of the second lateral support section;

a supporting unit, comprising a rectangular body fastened to the second panel and a round cavity wherein the straight end of said elongated cylindrical bar is inserted and secured;

f) an upper inner hoop supporting section comprising:

an elongated plate comprising a first hole, a central elongated groove and a second hole;

a first knurled screw and a second knurled screw, wherein said first and second knurled screws are inserted through the central elongated groove of the elongated plate with its threaded ends pointing outwardly relative to the mounting section;

a first knurled screw handle knob and a second knurled screw handle knob;

a first holding bracket comprising a main body with an opening inserted in the first knurled screw and further secured with the first knurled screw handle knob;

a second holding bracket comprising a main body with an opening inserted in the second knurled screw and further secured with the second knurled screw handle knob;

a third knurled screw passing through said first hole of the elongated plate and threaded to the threaded lateral hole of the first sliding unit in the first lateral support section;

a fourth knurled screw passing through said second hole of the elongated plate and threaded to the threaded lateral hole of the first sliding unit in the second lateral support section;

f) a lower inner hoop supporting section comprising:
an elongated plate comprising a first hole, a central elongated groove and a second hole;
a first knurled screw and a second knurled screw, both of them inserted though the central elongated groove of the elongated plate with its threaded ends outwardly positioned relative to the mounting section;
a first knurled screw handle knob and a second knurled screw handle knob;
a first holding bracket comprising a main body with an opening inserted in the first knurled screw and further secured with the first knurled screw handle knob;
a second holding bracket comprising a main body with an opening inserted in the second knurled screw and further secured with the second knurled screw handle knob;
a third knurled screw passing through said first hole of the elongated plate and threaded to the threaded lateral hole of the first sliding unit in the second lateral support section;
a fourth knurled screw passing through said second hole of the elongated plate and threaded to the threaded lateral hole of the second sliding unit in the second lateral support section;
h) a rearward support section which allows the mounting section to be secured in a selected angled position, said rearward support section comprising:
an inverted U-shaped bar having a first bent end and a second bent end;
a first clamp and a second clamp, fastened to the back surface of the first and third panels respectively and confining the U-shaped bar to the back surface of the first and third panels;
a first multi-perforated bar and a second multi-perforated bar; each one of said perforated bar fastened in to the base and wherein the first bent end and the second bent end of the inverted U-shaped bar are inserted in a predetermined aligned perforations on the first and second multi-perforated bars respectively in order to maintain the mounting section in an selective angled position; and
wherein:
the upper and the lower inner hoop support sections are movable upwardly and downwardly along the elongated cylindrical bars on the first and second lateral support sections once the third and fourth knurled screws of the upper inner hoop support section, which are threaded to the first sliding unit in the first lateral support section and the first sliding unit of the second lateral support section, respectively, and the third and fourth knurled screws of the lower inner hoop support section, which are threaded to the second sliding unit in the first lateral support section and to the second sliding unit in the second lateral support section, respectively, are loosed; and wherein the upper and the lower inner hoop support sections are confined to a predetermined or selective position along said elongated cylindrical bars on the first and second lateral support sections once said third and fourth knurled screws of the upper inner hoop section and the third and fourth knurled screws of the lower inner hoop section, respectively, are tightened; and
wherein:
the first and second holding brackets of the upper inner hoop support section are rotatable around the first knurled screw and the second knurled screw, respectively, and are also movable horizontally along the central elongated groove of the elongated plate of the upper inner hoop supporting section once the first and second knurled screw handle knobs of said upper hoop support section are loosed and wherein said first and second holding brackets of the upper inner hoop support section are selectively confined to a predetermined position along said central elongated hoop by tightening said first and second knurled screw handle knobs; and
wherein
the first and second holding brackets of the lower inner hoop support section are rotatable around the first knurled screw and the second knurled screw, respectively, and are also movable horizontally along the central elongated groove of the elongated plate of the lower inner hoop supporting section once the first and second knurled screw handle knobs of said upper hoop support section are loosed and wherein said first and second holding brackets of the lower inner hoop support section are selectively confined to a predetermined position along said central elongated hoop by tightening said first and second knurled screw handle knobs.

8. A portable apparatus for mounting a dual hoop system for embroidery onto a section of an item to be embroidered, said apparatus comprising:
a) a base comprising a flat top surface, a flat bottom surface, a proximal end, a distal end, a left side a right side, a knurled screw inserted from the flat bottom surface to the flat top surface, a knurled screw handle knob on said knurled screw;
b) a first mounting section, said first mounting section comprising:
a first panel comprising a flat front surface, a flat back surface, proximal end, a distal end, a left side, a right side and a hole on said left side;
a second panel comprising a flat front surface, a flat back surface, proximal end, a distal end, a left side, a right side and a hole on its right side;
a joining system configured to join said first and second panels in an aligned position, said joining system comprising a first joining plate and a second joining plate, fastened to the flat back surface of said first and second panels;
c) a connecting system for connecting the mounting section to the base by connecting the first and second panels of the mounting section to the proximal end of the base, said connecting system allowing the mounting section to move inwardly and outwardly in relation to the distal side of the base and from left to right and vice versa in relation to the proximal side of the base;
d) a first lateral support section comprising:
a first sliding unit and a second sliding unit, each of said sliding units comprising a main body with a central aperture passing throughout said main body and a threaded lateral hole perpendicular to and in direct contact with said central aperture;
an elongated cylindrical bar comprising an elongated body having an angled end, which is inserted into the hole on said left side of the first panel, and a straight end; said elongated cylindrical bar positioned in parallel to the left side of the first panel, and wherein said elongated body is inserted through the central aperture of the first and second sliding units, allowing said first and second sliding units to slide upwardly and downwardly along said elongated bar;

a supporting unit comprising a rectangular body fastened to the first panel and a round cavity wherein the straight end of said elongated cylindrical bar is inserted and secured;

e) a second lateral support section, comprising:

a first sliding unit and a second sliding unit, each of said sliding units comprising a main body with a central aperture passing throughout said main body and a threaded lateral hole perpendicular to and in direct contact with said central aperture;

an elongated cylindrical bar comprising an elongated body having an angled end, which is inserted into the hole on said right side of the third panel, and a straight end; said elongated cylindrical bar positioned in parallel to the right side of the second panel, and wherein said elongated body is inserted through the central aperture of the first and second sliding units of the second lateral support section, allowing said first and second sliding units to slide upwardly and downwardly along said elongated bar of the second lateral support section;

a supporting unit, comprising a rectangular body fastened to the second panel and a round cavity wherein the straight end of said elongated cylindrical bar is inserted and secured;

f) an upper inner hoop supporting section comprising:

an elongated plate comprising a first hole, a central elongated groove and a second hole;

a first knurled screw and a second knurled screw, wherein said first and second knurled screws are inserted through the central elongated groove of the elongated plate with its threaded ends pointing outwardly relative to the mounting section;

a first knurled screw handle knob and a second knurled screw handle knob;

a first holding bracket comprising a main body with an opening inserted in the first knurled screw and further secured with the first knurled screw handle knob;

a second holding bracket comprising a main body with an opening inserted in the second knurled screw and further secured with the second knurled screw handle knob;

a third knurled screw passing through said first hole of the elongated plate and threaded to the threaded lateral hole of the first sliding unit in the first lateral support section;

a fourth knurled screw passing through said second hole of the elongated plate and threaded to the threaded lateral hole of the first sliding unit in the second lateral support section;

g) a lower inner hoop supporting section comprising:

an elongated plate comprising a first hole, a central elongated groove and a second hole;

a first knurled screw and a second knurled screw, both of them inserted though the central elongated groove of the elongated plate with its threaded ends outwardly positioned relative to the mounting section;

a first knurled screw handle knob and a second knurled screw handle knob;

a first holding bracket comprising a main body with an opening inserted in the first knurled screw and further secured with the first knurled screw handle knob;

a second holding bracket comprising a main body with an opening inserted in the second knurled screw and further secured with the second knurled screw handle knob;

a third knurled screw passing through said first hole of the elongated plate and threaded to the threaded lateral hole of the first sliding unit in the second lateral support section;

a fourth knurled screw passing through said second hole of the elongated plate and threaded to the threaded lateral hole of the second sliding unit in the second lateral support section;

h) a rearward support section which allows the mounting section to be secured in a selected angled position, said rearward support section comprising:

an inverted U-shaped bar having a first bent end and a second bent end;

a first clamp and a second clamp, fastened to the back surface of the first and third panels respectively and confining the U-shaped bar to the back surface of the first and third panels;

a first multi-perforated bar and a second multi-perforated bar; each one of said perforated bar fastened in to the base and wherein the first bent end and the second bent end of the inverted U-shaped bar are inserted in a predetermined aligned perforations on the first and second multi-perforated bars respectively in order to maintain the mounting section in an selective angled position;

i) a third panel, said third panel comprising:

a flat front surface, a flat back surface, a proximal end, a distal end, a left side, a right side and a hole near the distal end; wherein said third panel is positioned in between the first and second panels, with its flat back surface over the flat top surface of the base, its distal end over the flat back surface of the base and its proximal end coming out of the base and the knurled screw on the base inserted to the hole near the distal end of said third panel, which is further secured to the base by threatening a knurled screw handle knob on said knurled screw on the base;

j) a second mounting area, said second mounting area comprising:

a first knurled screw inserted from the flat back surface to the flat front surface of said third panel;

a second knurled screw inserted from the flat back surface to the flat front surface of said third panel;

a third knurled screw inserted from the flat back surface to the flat front surface of said third panel;

a fourth knurled screw inserted from the flat back surface to the flat front surface of said third panel;

a first holding bracket inserted in the first knurled screw;

a second holding bracket inserted in the second knurled screw;

a third holding bracket inserted in the third knurled screw;

a fourth holding bracket inserted in the fourth knurled screw;

a first knurled screw handle knob threaded in the first knurled screw securing said first holding bracket;

a second knurled screw handle knob threaded in the second knurled screw and securing said second holding bracket;

a third knurled screw handle knob, threaded in the third knurled screw securing said third holding bracket;

a fourth knurled screw handle knob, threaded in the fourth knurled screw securing said fourth holding bracket; and wherein:

the first, second, third and fourth holding brackets rotate around the first, second, third and fourth knurled screws, respectively, once the corresponding knurled screw handle knob is loosened and wherein said first, second, third and fourth holding brackets are confined to a selected position on said third panel once the corresponding knurled screw handle knob is tightened; and wherein:

the upper and the lower inner hoop support sections are movable upwardly and downwardly along the elongated cylindrical bars on the first and second lateral support sections once the third and fourth knurled screws of the upper inner hoop support section, which are threaded to the first sliding unit in the first lateral support section and the first sliding unit of the second lateral support section, respectively, and the third and fourth knurled screws of the lower inner hoop support section, which are threaded to the second sliding unit in the first lateral support section and to the second sliding unit in the second lateral support section, respectively, are loosened; and wherein the upper and the lower inner hoop support sections are confined to a predetermined or selective position along said elongated cylindrical bars on the first and second lateral support sections once said third and fourth knurled screws of the upper inner hoop section and the third and fourth knurled screws of the lower inner hoop section, respectively, are tightened; and wherein:

the first and second holding brackets of the upper inner hoop support section are rotatable around the first knurled screw and the second knurled screw, respectively, and are also movable horizontally along the central elongated groove of the elongated plate of the upper inner hoop supporting section once the first and second knurled screw handle knobs of said upper hoop support section are loosed and wherein said first and second holding brackets of the upper inner hoop support section are selectively confined to a predetermined position along said central elongated hoop by tightening said first and second knurled screw handle knobs; and wherein:

the first and second holding brackets of the lower inner hoop support section are rotatable around the first knurled screw and the second knurled screw, respectively, and are also movable horizontally along the central elongated groove of the elongated plate of the lower inner hoop supporting section once the first and second knurled screw handle knobs of said upper hoop support section are loosed and wherein said first and second holding brackets of the lower inner hoop support section are selectively confined to a predetermined position along said central elongated hoop by tightening said first and second knurled screw handle knobs.

* * * * *